US005940660A

United States Patent [19]

Saito

[11] Patent Number: 5,940,660

[45] Date of Patent: Aug. 17, 1999

[54] CHARGING DEVICE AND IMAGE FORMING APPARATUS

[75] Inventor: Hitoshi Saito, Mie-ken, Japan

[73] Assignee: Minolta Co., Ltd., Osaka, Japan

[21] Appl. No.: 08/999,124

[22] Filed: Dec. 29, 1997

[30] Foreign Application Priority Data

| | | | |
|---|---|---|---|
| Dec. 28, 1996 | [JP] | Japan | 8-358451 |
| Jun. 24, 1997 | [JP] | Japan | 9-167662 |
| Sep. 16, 1997 | [JP] | Japan | 9-250283 |
| Sep. 18, 1997 | [JP] | Japan | 9-252948 |

[51] Int. Cl.[6] ..... G03G 15/02

[52] U.S. Cl. ..... 399/174; 361/225

[58] Field of Search ..... 399/174, 168, 399/314; 361/220, 225, 214; 430/902

[56] References Cited

U.S. PATENT DOCUMENTS

| | | | |
|---|---|---|---|
| 5,278,614 | 1/1994 | Ikegawa et al. . | |
| 5,376,995 | 12/1994 | Yamamoto et al. | 399/174 |
| 5,428,428 | 6/1995 | Haneda | 399/276 |
| 5,475,471 | 12/1995 | Kisu et al. | 399/168 X |
| 5,535,088 | 7/1996 | Sato et al. | 361/225 |
| 5,666,601 | 9/1997 | Genovese et al. | 399/168 |

FOREIGN PATENT DOCUMENTS

| | | |
|---|---|---|
| 62-296174 | 12/1987 | Japan . |
| 5-188730 | 7/1993 | Japan . |
| 6-90568 | 11/1994 | Japan . |
| 8-006352 | 1/1996 | Japan . |

*Primary Examiner*—Arthur T. Grimley
*Assistant Examiner*—Sophia S. Chen
*Attorney, Agent, or Firm*—McDermott, Will & Emery

[57] ABSTRACT

A charging device which includes a sheet-like charging member to be brought into contact with a charge target member. The charging member being composed of at least an insulating layer and a resistance layer. The charging device further includes at least one voltage application device which applies a DC voltage to the resistance layer of the charging member. The resistance layer has a down stream portion which protrudes from the insulating layer, which is arranged at the side of the resistance layer of the charge target member. The down stream portion may take on various shapes which uniformly apply a charge to the charge target member. The charging member may further include another resistive layer which has a second voltage applied thereto, wherein the other resistive layer is mounted on the other side of the insulating layer and contacts the charge target member and securely holds the charging member in contact with the charge target member.

22 Claims, 18 Drawing Sheets

CHARGING DEVICE AND IMAGE FORMING APPARATUS

This application is based on applications Nos. 8-358451 Pat., 9-167662 Pat., 9-250283 Pat. and 9-252948 Pat. filed in Japan, the Contents of which are hereby in corporated by reference.

BACKGROUND OF THE INVENTION

1. Field of the Invention

The present invention relates to a charging device which can be employed in a copying machine, a printer, a facsimile machine or a complex machine including a combination of at least two of them, and also relates to an image forming apparatus employing such a charging device.

2. Description of the Related Art

In an image forming apparatus such as a copying machine or a printer, a surface of an electrostatic latent image carrier is uniformly charged prior to image exposure which is performed for forming an electrostatic latent image on the image carrier. A transfer voltage is applied to a record member such as a paper sheet or an intermediate transfer member for a transfer operation. More specifically, the transfer operation are performed for transferring a toner image formed on the image carrier onto a record member such as a paper sheet. In a multi-color image forming apparatus and others, the transfer operation is also performed for transferring a toner image onto the intermediate transfer member prior to transfer onto the record member. The foregoing transfer voltage is applied onto a rear surface of the record member or the intermediate transfer member for the above transfer operations. Further, a voltage for discharging may be applied for removing electric charges remaining on the electrostatic latent image carrier in a discharging section after the transfer of the toner image.

The foregoing charging and voltage application are performed by various kinds of charging devices. In one of the devices already proposed, a charging member for charging a charge target member, i.e., member to be charged has a sheet-like form.

In a device disclosed, e.g., in Japanese Patent Publication No. 6-90568 (90568/1994), a solid electrode plate is formed of an electric resistance member in a plate form having a volume resistivity of $10^6 10^{13}$ Ω·cm and a surface resistivity of $10^6$ Ω/□ ($10^6$ ohm/□) or more. A voltage application electrode is adhered onto a first surface of this solid electrode plate, and a second surface of the solid electrode plate is opposed to the charge target member with a minute space of 500 μm or less therebetween, i.e., without establishing a direct contact between them. A voltage is applied to the voltage application electrode for charging.

According to the charging device taught by Japanese Patent Publication No. 6-90568, however, it is difficult to prevent contact between the solid electrode plate and the charge target member and to keep a constant space between them, so that abnormal discharging is liable to occur at an end of the solid electrode plate, resulting in defective charging such as irregular charging.

SUMMARY OF THE INVENTION

Accordingly, it is an object of the invention to provide a charging device for charging a charge target member by a charging member in a sheet-like form, and particularly a charging device which can effect good charging on a charge target member.

Also, it is an object of the invention to provide a charging device for charging a charge target member by a charging member in a sheet-like form, and particularly a charging device which can effect good charging on a charge target member without an influence by waving or vibration of the charge target member.

Further, it is an object of the invention to provide an image forming apparatus in which good charging can be effected on a charge target member for formation of an electrostatic latent image.

In order to achieve the above objects, the invention provides a charging device comprising:

a sheet-like charging member to be brought into contact with a charge target member, and having an insulating layer and a first resistance layer; and a first voltage application device for applying a DC voltage to the first resistance layer, wherein the insulating layer of the charging member is arranged at a side of the first resistance layer neighboring to the charge target member, and the first resistance layer has a downstream end portion, in a surface moving direction of the charge target member, protruding from the insulating layer in the surface moving direction of the charge target member.

In order to achieve the above object, the invention also provides an image forming apparatus for forming an electrostatic latent image on a charge target member and developing the electrostatic latent image to form an image, comprising:

a sheet-like charging member to be brought into contact with the charge target member, and having an insulating layer and a first resistance layer; and a first voltage application device for applying a DC voltage to the first resistance layer, wherein the insulating layer of the charging member is arranged at a side of the first resistance layer neighboring to the charge target member, and the first resistance layer has a downstream end portion, in a surface moving direction of the charge target member, protruding from the insulating layer in the surface moving direction of the charge target member.

The foregoing "sheet-like charging member to be brought into contact with the charge target member" is a member which is provided for charging, has a sheet-like, a plate-like or a film-like form and can be brought into contact with the charge target member.

According to the above charging device, the sheet-like charging member is brought into surface-contact with the surface of the charge target member in such a state that the insulating layer neighbors to the charge target member, and the first resistance layer is remote from the charge target member with the insulating layer therebetween. Also, the first resistance layer is supplied with the DC voltage for charging from the DC voltage application device.

Foreign matters, which are brought onto the sheet-like charging member in accordance with movement of the surface of the charge target member, are stopped and held by mutual contact portions of the charging member and charge target member. Charging is performed by the first resistance layer.

The first resistance layer has the downstream end portion, in the surface moving direction of the charge target member, which protrudes from the insulating layer in the surface moving direction of the charge target member, and is not in contact with the charge target member. This protruding end portion carries out the charging, and keeps a constant charging space equal to at least a thickness of the insulating layer with respect to the charge target member.

As described above, the foreign matters which come to a position of the mutual contact portions in accordance with the movement of the surface of the charge target member are stopped and held at the position, and the constant distance is maintained between the first resistance layer performing the charging and the charge target member, so that irregular charging is suppressed, and good charging is performed. Even when the foreign matters which were held at an upstream position move through a position under the sheet-like charging member to a position on the downstream end of the insulating layer, the downstream protruding end portion of the resistance member can perform the charging, and the foreign matters rapidly pass through the above position in accordance with movement of the surface of the charge target member, which enables uniform charging.

Since the sheet-like charging member is in contact with the charge target member, the charging member accurately follows the charge target member without an influence by waving or vibration due to irregularities in the surface moving speed of the charge target member. Also, the charging space of a constant distance equal to at least the thickness of the insulating layer can be reliably maintained, so that the charging can be performed stably.

In the foregoing image forming apparatus, the charging for formation of the electrostatic latent image is performed by the charging device described above, so that the charging can be performed uniformly, and thus a good image can be formed.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
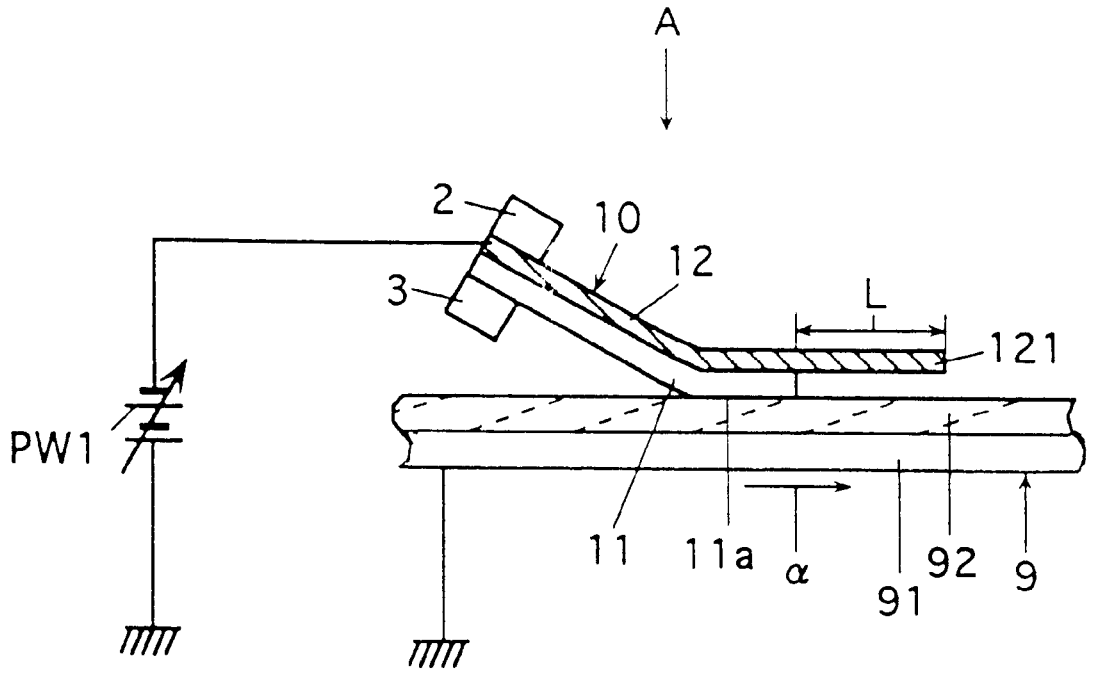
FIG. 1 is a side view of a charging device of an embodiment of e invention.

A charging device according to the invention comprises, as already described, a sheet-like charging member to be brought into contact with a charge target member, and having an insulating layer and a first resistance layer; and a first voltage application device for applying a DC voltage to the first resistance layer. The insulating layer of the charging member is arranged at a side of the first resistance layer neighboring to the charge target member, and the first resistance layer has a downstream end portion, in a surface moving direction of the charge target member, protruding from the insulating layer in the surface moving direction of the charge target member.

An image forming apparatus according to the invention uses the above charging device for charging the surface of the charge target member for forming an electrostatic latent image prior to formation of the electrostatic latent image.

The charging device will be described below more in detail.

The sheet-like charging member may be provided with a second resistance layer arranged at a side of the insulating layer neighboring to the charge target member, and a second voltage application device may be provided for applying a voltage to the second resistance layer.

In this case, the second voltage application device for applying the voltage to the second resistance layer may be (1) a DC voltage application device, (2) an oscillating voltage application device, or (3) a device applying DC and oscillating voltages in a superposed manner.

If the DC voltage application device is employed as the second voltage application device, the DC voltage can be applied to the second resistance layer to effect a preliminary charging from the resistance layer at a position upstream to its portion in contact with the charge target member. Also, the sheet-like charging member can be electrostatically adhered to the charge target member, whereby the sheet-like charging member can further sufficiently follow the charge target member without being affected by waving or vibration due to variation in surface moving speed of the charge target member, and the distance between the charge target member and the first resistance layer can be maintained further stably.

When the DC voltage application device is employed as the second voltage application device, the first voltage application device for applying the DC voltage to the first resistance layer as well as the second voltage application device may perform the voltage application such that the DC voltage applied to the second resistance layer is of the same polarity as the DC voltage applied to the first resistance layer and is lower in absolute value than the DC voltage applied to the first resistance layer.

By applying the voltages to the first and second resistance layers in the above manner, the sheet-like charging member can be electrostatically adhered onto the charge target member, so that the sheet-like charging member can sufficiently follow the charge target member without being affected by waving or vibration due to variation in surface moving speed of the charge target member, and the distance between the charge target member and the sheet-like charging member can be maintained stably. Also, foreign matters which come, in the surface moving direction of the charge target member, to the sheet-like charging member from an upstream position are charged to the same polarity, and thereby are prevented from being electrostatically adhered to the sheet-like charging member. This enables further stable charging.

In the structure employing the oscillating voltage application device as the second voltage application device, it can be prevented that the foreign matters, which come to the sheet-like charging member from an upstream position in the surface moving direction of the charge target member, are gathered and condensed on the contact portions of the charging member and the charge target member, and the condensed matters enter the space between the sheet-like charging member and the charge target member to cause variation in distance between the charging member and the charge target member. Thereby, stable charging can be performed while keeping a constant distance between the sheet-like charging member and the charge target member.

The oscillating voltage application device may be a device applying an AC voltage, or a device applying a DC voltage while performing switching (for example, repeating on and off of a pulse voltage, repeating application of a high pulse voltage and a low pulse voltage, or repeating application of positive and negative voltages).

The structure employing the second voltage application device formed of the device, which applies a DC voltage and an oscillating voltage in a superposed manner, can achieve the advantages obtained by both the DC voltage application device and the oscillating voltage application device described above.

The protruding end or edge of the downstream protruding end portion of the first resistance layer may be coated with an insulating layer.

According to this structure, the insulating layer coating the protruding end can prevent abnormal discharging from the protruding end, and thus can prevent electrostatic adhesion of the protruding end onto the charge target member, which may be caused by abnormal discharging. Thereby, a constant distance between the protruding end and the charge target member can be maintained, which enables further stable charging.

The protruding end of the downstream protruding end portion of the first resistance layer, and particularly the edge of the protruding end opposed to the charge target member may have a curved surface of an arc-shaped section. The curved surface having the arc-shaped section includes, in addition to the surface of the arc-shaped section itself, a curved surface having a section similar to the arc-shaped section, and, in other words, is a convex curved surface having no local projection.

The protruding end of the downstream protruding end portion of the first resistance layer may specifically be one of the following ends:

A protruding end which is folded back away from the charge target member to form a round section.

A protruding end which is bent away from the charge target member, and the outer surface of the bent portion (i.e., surface opposed to the charge target member and thus forming the edge of the protruding end) has an arc-shaped round section.

A protruding end of which arc-shaped section is formed by effecting processing or working on the protruded end itself.

By employing the protruding end described above, it is possible to prevent concentration of charges at the protruding end, and therefore it is possible to suppress abnormal discharging at the protruding end and thus irregular charging of the charge target member. Owing to this, it is possible to suppress defective charging at the downstream protruding end portion of the first resistance layer, and good charging of the charge target member is allowed.

The downstream protruding end portion of the first resistance layer may have such a form that a distance of the protruding end portion from the charge target member increases as the position moves toward the protruding end, and is kept at a value which does not cause discharging from the protruding end to the charge target member.

In this case, the first resistance layer may have the following structures:

The whole downstream protruding end portion extending from the position above the insulating layer toward the protruding end diverges with respect to the charge target member to increase gradually the distance between them.

Only a portion of the downstream protruding end portion extending from its intermediate position to the protruding end diverges with respect to the charge target member to increase gradually the distance between them.

The downstream protruding end portion has an arc-shaped section, and thereby diverges with respect to the charge target member to increase progressively the distance between them.

By employing the above first resistance layer, it is possible to suppress abnormal discharging at the downstream protruding end portion, and therefore irregular charging of the charge target member. Thereby, it is possible to suppress defective charging at the downstream protruding end portion, and good charging of the charge target member can be performed.

The sheet-like charging member may have a reinforcing layer which is provided for at least the downstream protruding end portion of the first resistance layer.

In this case, the reinforcing layer reinforces the downstream protruding end portion of the first resistance layer to suppress deformation of the protruding end portion, and thereby electrostatic adhesion of the protruding end portion to the charge target member is prevented during application of the voltage, so that a constant distance is maintained between the protruding end portion and the charge target member, which enables stable charging.

The reinforcing layer may be arranged, for example, at the side of the first resistance layer remote from the charge target member.

Instead of or together with the reinforcing layer, the thickness of the first resistance layer itself may be increased.

The volume resistivity of the first resistance layer may be in a range from about $10^3$ Ω·cm to about $10^7$ Ω·cm, although not restricted thereto.

The volume resistivity of the first resistance layer in a range from about $10^3$ Ω·cm to about $10^7$ Ω·cm can prevent abnormal dot discharging, and therefore can prevent electrostatic adhesion of the downstream protruding end portion of the first resistance layer onto the charge target member, which may be caused by abnormal discharging, so that a constant distance can be maintained between the protruding end portion and the charge target member, and stable charging can be performed.

Likewise, the volume resistivity of the second resistance layer may be in a range from about $10^3$ Ω·cm to about $10^7$ Ω·cm, although not restricted thereto.

The sheet-like charging member may have such a structure that, at the region of contact between the sheet-like charging member and the charge target member, a distance from 11 μm to 300 μm and more preferably from 11 μm to 100 μm is set between the charge target member and the first resistance layer.

In this case, good discharging can be performed, so that it is possible to prevent abnormal discharging and therefore electrostatic adhesion of the downstream protruding end portion of the first resistance layer to the charge target member, which may be caused by the abnormal discharging, and therefore a constant distance can be maintained between the protruding end portion and the charge target member.

Also, a quantity of produced ozone can be reduced, and deterioration of the sheet-like charging member by the ozone can be prevented, so that reduction in rigidity and breakage of the protruding end portion of the first resistance layer can be prevented.

In any of the charging devices described above, the first and second resistance layers may be made of a material, which is selected, for example, from a synthetic resin such as a fluorine-contained resin (polytetrafluoroethylene or the like), polyimide, polyester or polyether, and rubber such as urethane rubber, and contains electrically conductive material dispersed therein, although not restricted thereto.

The insulating layer may be made of a material, which is selected, for example, from a synthetic resin such as a fluorine-contained resin (polytetrafluoroethylene or the like), polyimide, polyester or polyether, and rubber such as urethane rubber, although not restricted thereto.

The first resistance layer and the insulating layer may be formed of independent members layered together, or may have an integral structure made of a resistance inclination composite material. In the latter case, the resistance value is large at the side near the charge target member, and the portion near the charge target member has an insulating property and therefore corresponds to the insulating layer. The resistance value lowers as the position moves away from the charge target member, and thereby a portion corresponding to the first resistance layer is formed.

In any one of the charging devices described above, the first resistance layer may be eliminated from side edge portions of the sheet-like charging member, which extend in the surface moving direction of the charge target member and, in other words, form opposite end portions in the direction perpendicular to the surface moving direction of the charge target member. The purpose of this elimination is to prevent abnormal discharging from the side edge portions.

In any one of the foregoing charging devices, the downstream protruding end portion of the first resistance layer may protrude from the insulating layer by a protrusion distance L (mm) which establishes the following relationship. Assuming that the surface moving speed of the charge target member is Vp (mm/sec), and a proximity discharging time T (sec) is obtained by dividing the protrusion distance L (mm) by Vp (mm/sec) (i.e., T=L/Vp), the proximity discharging time T is in a range from 0.002 sec to 0.3 sec, and more preferably from 0.005 sec to 0.1 sec. If the time T were shorter than 0.002 sec, insufficient charging would cause defective charging. If it were longer than 0.3 sec, deformation or waving of the sheet-like charging member would occur, and thereby insufficient charging would occur due to irregular charging.

As already described, the charging device according to the invention can be utilized as a charging device for charging a charge target member (electrostatic latent image carrier) prior to image exposure in an image forming apparatus such as a copying machine or a printer, and can also be utilized as a device for transferring a toner image formed on the image carrier onto a record member such as a paper sheet or transferring the toner image onto an intermediate transfer member prior to transfer of the toner image onto the record member in a multi-color image forming apparatus. Further, the charging device can be utilized, for example, as a discharging device for removing charges remaining on the electrostatic latent image carrier after transfer of the toner image.

Embodiments of the invention will now be described below.

FIG. 1 shows a charging device A and a charge target member 9 to be charged by the device A.

The charging device A shown in FIG. 1 includes a sheet-like charging member 10 as well as holder members 2 and 3 holding the member 10. The holder members 2 and 3 extend in a direction crossing a surface moving direction α of the charge target member 9. The charging member 10 is held in a cantilever manner by the holder members 2 and 3 holding one end thereof, and a portion of the charging member 10, which is downstream, in the surface moving direction α of the charge target member, to the held end, is elastically and flexibly brought into surface-contact with the charge target member 9.

The sheet-like charging member 10 has a width in the direction crossing the surface moving direction α of the charge target member. The charge target member 9 is driven at a surface moving speed Vp (mm/sec).

The sheet-like charging member 10 includes an electric insulating layer (insulating layer) 11 for contact with the charge target member 9, and a first resistance layer 12 layered over the insulating layer 11. In other words, the is insulating layer 11 is an insulating sheet 11, and the first resistance layer 12 is a sheet electrode 12.

A downstream end portion 121, in the surface moving direction α of the charge target member, of the sheet electrode 12 protrudes in the same direction α from the downstream end of the insulating sheet 11 by a small distance L. This protrusion distance L (mm) is set to attain the foregoing proximity discharging time T (=L/Vp) in a range from 0.005 to 0.1 sec.

The sheet electrode 12 is connected to a DC power supply PW1, which can apply a DC voltage of, e.g., −1500 V to the sheet electrode 12.

By application of the voltage to the sheet electrode 12, discharging occurs at the downstream protruding end portion 121, so that the surface of the charge target member 9 is substantially uniformly charged to a voltage, e.g., from −600 V to −900 V.

The charge target member 9 in this embodiment is formed of an electrically conductive support 91 and a photoconductive layer 92 formed over the support 91. The charging device of the invention can be applied also to the charge target member, in which a dielectric layer is employed instead of the photo-conductive layer 92, or the charge target member formed of a single layer of a dielectric material.

Although the charge target member 9 shown in the figures has a sheet-like form, it may have another form such as a drum-like or belt-like form.

The thickness of the insulating sheet 11, and particularly the thicknesses of a contact portion 11*a* of the insulating sheet 11 to be in contact with the charge target member 9 and a portion near the contact portion 11*a* may be set to 11 μm or more for good discharging in accordance with the Paschen's Law, and may be in a range not exceeding 300 μm and more preferably 100 μm or less in view of a relationship between the discharging distance and the ozone production rate. The thickness of the insulating sheet 11 is uniformed to an extent which does not exert a significant influence on the discharging. According to the above range, the portion having the above thickness maintains a constant distance between the downstream protruding end portion 121 of the sheet electrode 12, which is supplied with the discharging voltage and thereby performs the discharging, and the charge target member 9.

The insulating sheet 11 may be made of a material, which is selected, for example, from a synthetic resin such as a fluorine-contained resin (polytetrafluoroethylene or the like), polyimide, polyester or polyether, and rubber such as urethane rubber, although not restricted thereto.

The contact portion 11*a* of the insulating sheet 11 for contact with the charge target member 9 is preferably made of a material which has a high wear resistance and provides a small friction coefficient with respect to the charge target member 9.

The sheet electrode 12 has an appropriate resistance value, and particularly a volume resistivity, which is $10^3$ Ω·cm or more for preventing abnormal dot discharging or the like, and thereby performing stable discharging, but does not exceed $10^7$ Ω·cm for preventing an excessively high resistance value requiring application of an excessively high voltage.

The discharging surface of the sheet electrode 12 is uniformed to an extent not exerting a significant influence on the discharging.

The sheet electrode 12 may be made of a material, which is selected, for example, from a synthetic resin such as a fluorine-contained resin (polytetrafluoroethylene or the like), polyimide, polyester or polyether, and rubber such as urethane rubber, and contains electrically conductive material dispersed therein, although not restricted thereto.

According to the charging device A described above, the sheet-like charging member 10 is brought into elastic (flexible) surface-contact with the moving surface of the charge target member 9. In this operation, the insulating sheet 11 comes into contact with the charge target member 9, and the sheet electrode 12 over the same is supplied with a DC voltage from the power supply PW1, so that the surface of the charge target member 9 is charged.

Foreign matters arrive at the sheet-like charging member 10 in accordance with movement of the surface of the charge target member 9. These foreign matters are stopped and held by the contact portion 11*a* of the charging member 10 in contact with the charge target member 9.

The sheet electrode 12 has the downstream protruding end portion 121 which protrudes from the insulating sheet 11. This downstream protruding end portion 121 actually performs the discharging, and keeps a constant discharging space equal to the thickness of the insulating sheet 11 with respect to the charge target member 9.

As described above, the foreign matters which arrived at a position in accordance with movement of the surface of the charge target member 9 are held at the position, and a s constant distance is maintained between the sheet electrode 12 performing the discharging and the charge target member 9, so that irregular charging is suppressed, and good charging is performed.

Even if the foreign matters which were held at an upstream position pass through a space on the sheet-like charging member 10 and arrive at the position of the protruding end portion 121 of the sheet electrode 12, the discharging occurs at the protruding end portion 121, and the foreign matters rapidly move through the above position in accordance with the movement of the surface of the charge target member. This enables uniform charging.

Since the sheet-like charging member 10 is brought into contact with the charge target member 9, it follows the charge target member 9 in a desired manner without being influenced by waving or vibration caused by variation in surface moving speed of the charge target member 9. Further, the sheet-like charging member 10 can reliably maintain the discharging space of the distance equal to the thickness of the insulating sheet 11. Therefore, the charging can be performed stably.

Figure 2:
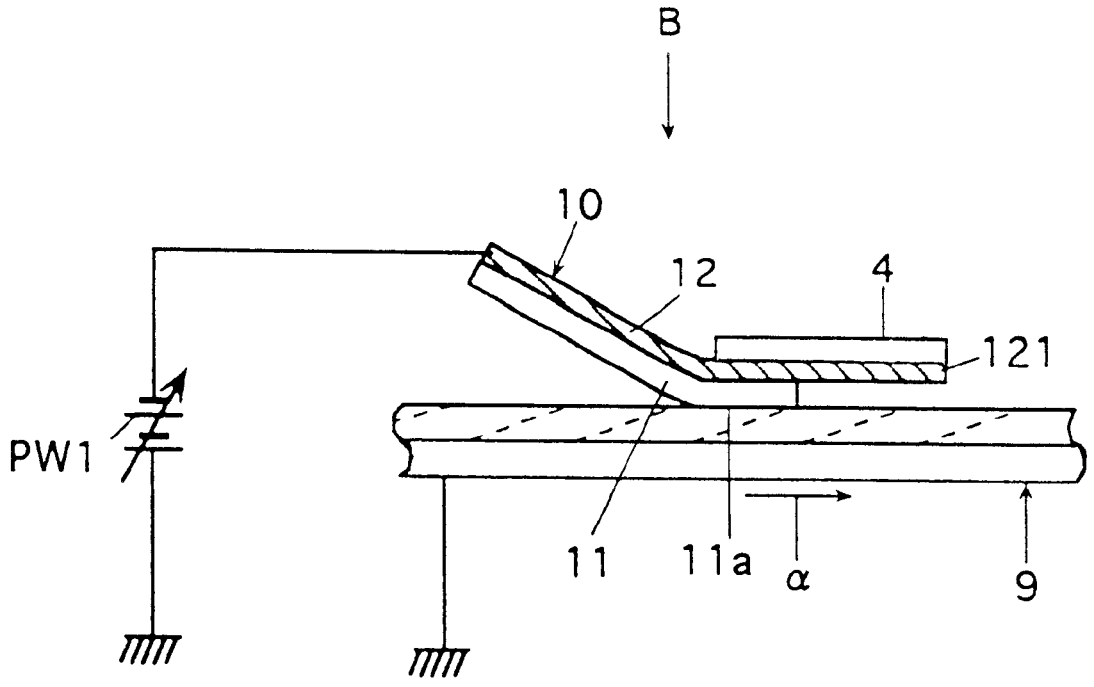
FIG. 2 is a side view of a charging device of another embodiment of the invention.
Figure 3:
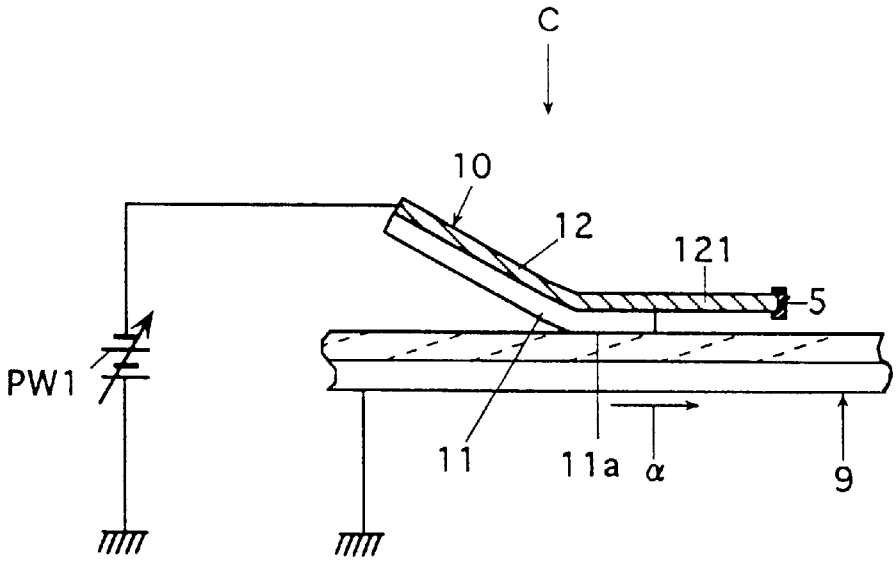
FIG. 3(A) is a side view of a charging device of still another embodiment of the invention.
FIG. 3(B) is a perspective view of the charging device in FIG. 3(A)
Figure 3:
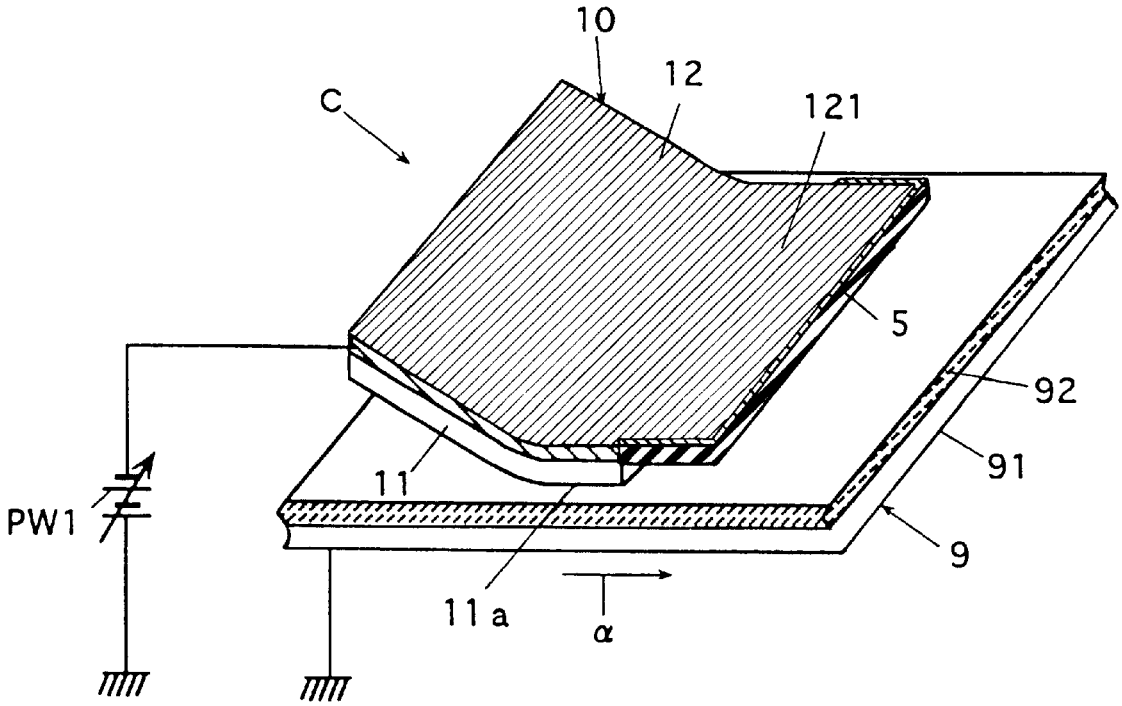

FIG. 2 shows another example of the charging device.

In the charging device B shown in FIG. 2, a reinforcing member or layer 4 is arranged on the sheet electrode 12 of the sheet-like charging member 10 for preventing bending of the downstream protruding end portion 121. In this charging device B, the same parts and portions as those of the device shown in FIG. 1 bear the same reference numbers. The holder members 2 and 3 are used for supporting the member 10, but not shown in FIG. 2. This is also true with respect to FIGS. 3 to 7 showing other examples which will be described later.

Owing to provision of the reinforcing member 4, it is possible to suppress the protruding end portion 121 of the sheet electrode 12 from being bent toward the charge target member 9 by an electrostatic attraction force when the power supply PW1 supplies a voltage to the sheet electrode 12. Thereby, a constant distance is kept reliably between the protruding end portion 121 and the charge target member 9, and the stable charging is enabled.

FIGS. 3(A) and 3(B) show still another example of a charging device.

In the charging device C shown in FIGS. 3(A) and 3(B), the protruding end and particularly the discharging end surface of the protruding end portion 121 of the sheet electrode 12 of the sheet-like charging member 10 is coated with an electric insulating layer 5. The same parts and portions as those of the device in FIG. 1 bear the same reference numbers.

According to this charging device C, abnormal discharging from the sheet electrode 12 is prevented by provision of the insulating layer 5.

Figure 4:
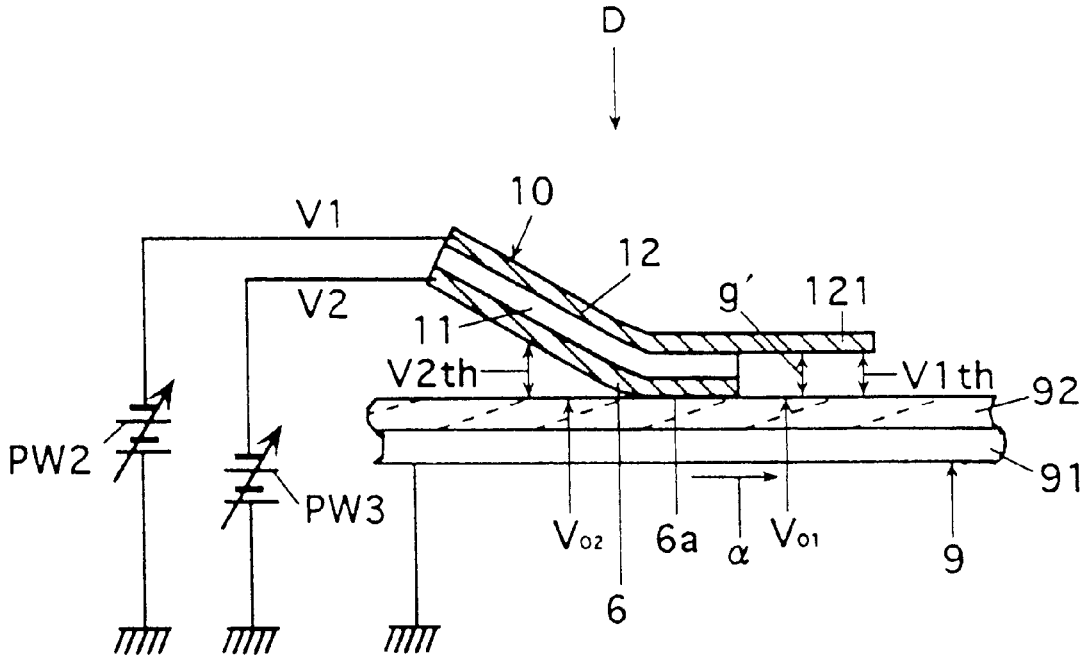
FIGS. 4 through 43 are side views of charging devices of different embodiments of the invention, respectively.

FIG. 4 shows further another example of a charging device.

In the charging device D shown in FIG. 4, a layer of a sheet electrode 6, which serves as a second resistance layer and is in contact with the charge target member 9, is arranged on the lower surface of the insulating sheet 11 of the sheet-like charging member 10. The same parts and portions as those of the device in FIG. 1 bear the same reference numbers.

A power supply PW2 is connected to the sheet electrode 12 on the insulating sheet 11, and supplies a DC voltage V1 to the sheet electrode 12. A DC power supply PW3 is connected to the sheet electrode 6, and can supply a DC voltage V2 of the same polarity as the voltage V1 to the sheet electrode 6.

In this device D, the voltage V2 is applied to the sheet electrode 6, so that the sheet-like charging member 10 is electrostatically and intimately adhered to the charge target member 9. Thereby, the sheet-like charging member 10 can follow the charge target member 9 in a desired manner without an influence by waving or vibration caused, e.g., by variation in surface moving speed of the charge target member 9, and the distance between the charge target member 9 and the sheet electrode 12 can be stably maintained.

The voltage V1 applied to sheet electrode 12 is desirably a voltage causing stable discharging at the protruding end portion 121 of the electrode 12. The conditions for causing the stable discharging can be as follows.

Assuming that a voltage of V2th starts the discharging by the sheet electrode 6 supplied with the voltage V2, and that the charge target member 9 charged by the sheet electrode 6 carries a surface potential of $V_{02}$, the surface potential $V_{02}$ is equal to a difference between the applied voltage V2 and the discharge start voltage V2th, and therefore is expressed by the following formula:

$$V_{02}=V2-V2th \quad (1)$$

Assuming that a voltage of V1th starts the discharging by the sheet electrode 12 supplied with the voltage V1, and that the charge target member 9 charged by the protruding end portion 121 of the sheet electrode 12 carries a surface potential of $V_{01}$, the surface potential $V_{01}$ is equal to a difference between the applied voltage V1 and the discharge start voltage V1th, and therefore is expressed by the following formula:

$$V_{01}=V1-V1th \quad (2)$$

A potential difference between the applied voltage V1 and the surface potential $V_{02}$ is a gap potential Vg' which is expressed by the following formula:

$$Vg'=V1-V_{02} \quad (3)$$

Discharging at the protruding end portion 121 is performed under such conditions that the gap potential Vg' is equal to or higher than the discharge start voltage V1th as expressed by the following formula:

$$Vg'\geqq V1th \quad (4)$$

From the formula (4) and the formula (3), the following formula is obtained:

$$V1-V_{02\geqq V}1th \quad (5)$$

By transforming the formula (5), the following formula is obtained:

$$V_{02}\leqq V1-V1th \quad (6)$$

From the formula (6) and the formula (2), the following formula is obtained:

$$V_{02}\leqq V_{01} \quad (7)$$

For stably causing the discharging at the protruding end portion 121, it is desired that the voltage V2 applied to the sheet electrode 6 is determined to provide the surface potential $V_{02}$ equal to or lower than the surface potential $V_{01}$ as expressed by the formula (7) ($V_{02}\leqq V_{01}$).

Figure 44:
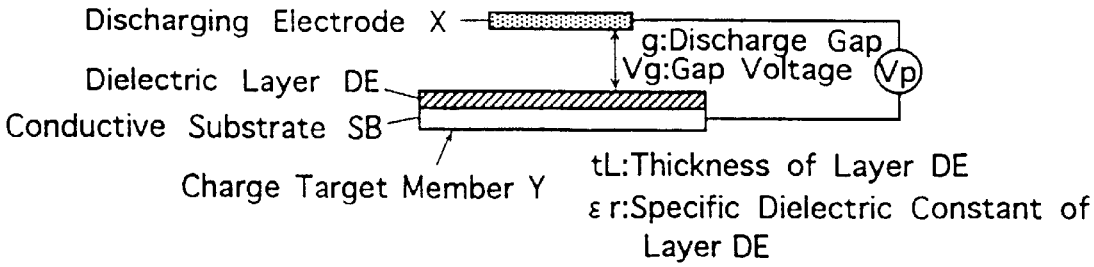
FIG. 44(A) shows an example of voltage application between a discharging electrode and a charge target member.
FIG. 44(B) shows a relationship between a discharging gap between the discharging electrode and the charge target member, a gap potential and a discharge start voltage.
Figure 44:
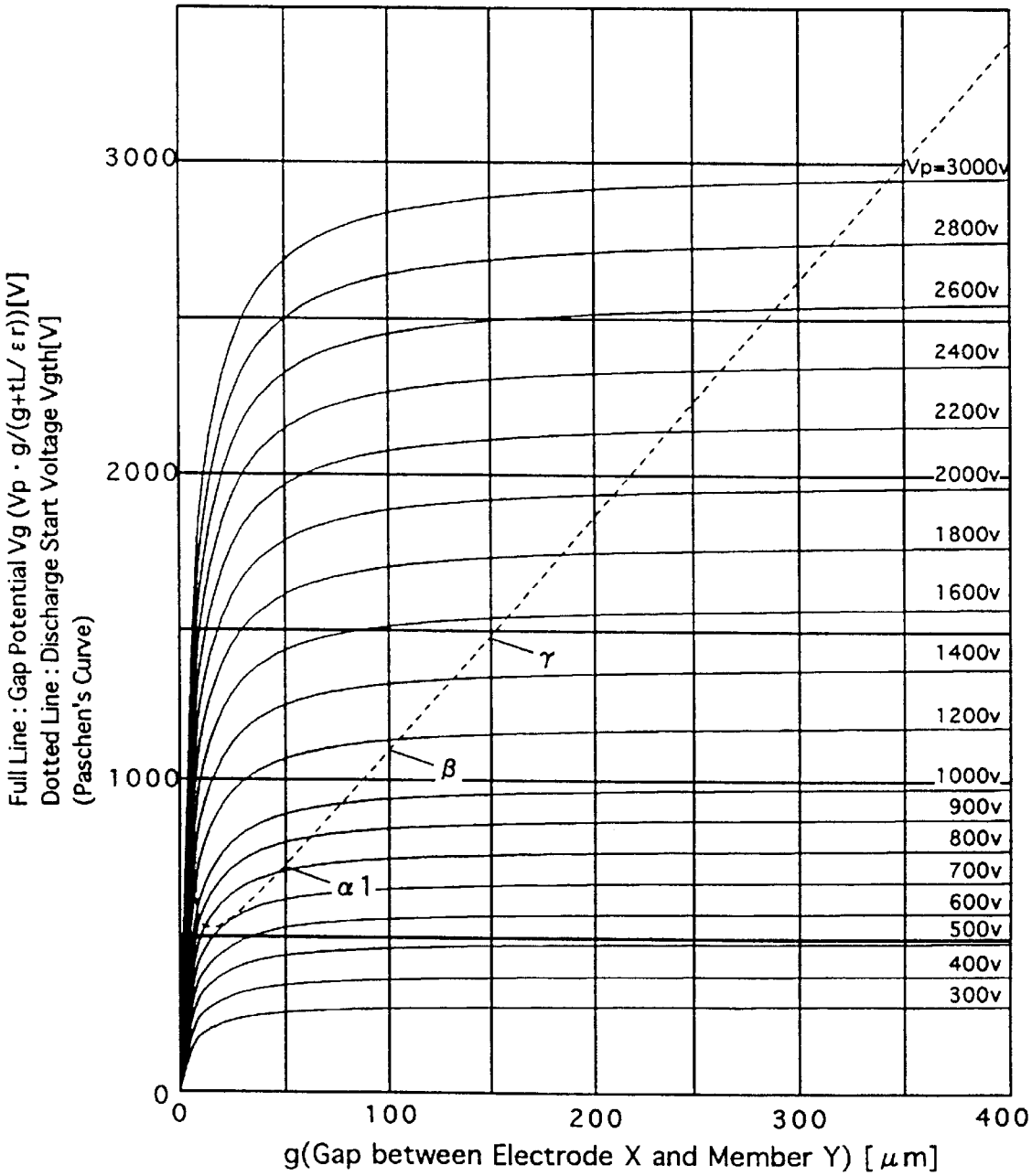

FIG. 44(A) shows a state of voltage application across a discharging electrode X and a charge target member Y. FIG. 44B shows a relationship between a discharging gap g between the discharging electrode and the charge target member, a gap potential (gap voltage) Vg and a discharge start voltage Vgth.

FIG. 44(B) shows the relationship between the gap g, the gap potential Vg and the discharge start voltage Vgth under the following conditions. A charge target member Y which is formed by applying onto a conductive substrate SB a dielectric layer DE having a specific dielectric constant $\epsilon r$ ($\epsilon r$=3 in this case) and a thickness tL ($\mu$m) (tL=18 $\mu$m in this case). The discharging electrode X is arranged on the charge target member Y with a gap therebetween. This gap is represented as the discharging gap g ($\mu$m). A voltage Vp (V) is applied to the discharging electrode X. A gap voltage at the discharging gap is represented by Vg (V). The discharge start voltage on the electrode is represented by Vgth (V). The positive voltage Vp is applied to the discharging electrode X.

In FIG. 44(B), the discharge start voltage Vgth (dotted line) represents Paschen's curve according to the Paschen's Law. In this case, discharging from the discharging electrode X to the charge target member Y is allowed in a region in which potential Vg and voltage Vgth satisfy a relationship of Vg $\geqq$Vgth.

FIG. 44(B) represents the relationship exhibited when the voltage Vp applied to the discharging electrode X is positive. However, if it is negative, the relationship can be represented by inverting the signs of voltages.

In the charging device D shown in FIG. 4, it is assumed that a discharging gap g' is formed between the protruding end portion 121 of the sheet electrode 12 and the charge target member 9, the specific dielectric constant $\epsilon r$ of the photoconductive layer 92 formed at the charge target member 9 is 3, and the thickness tL thereof is 18 $\mu$m. In this case, the discharging gap g, applied voltage Vp, gap potential Vg and discharge start voltage Vgth in FIG. 44(B) can correspond to the discharging gap g', the applied voltage V1, the gap potential Vg'(=V1−$V_{02}$) and the discharge start voltage V1th, respectively. It can be deemed that the relationships of the gap potential Vg and discharge start voltage Vgth with respect to the discharging gap g shown in FIG. 44B are substantially the same as those of the gap potential Vg'(=V1−$V_{02}$) and the discharge start voltage V1th with respect to the discharging gap g' in the charging device D shown in FIG. 4.

Accordingly, the voltage V1 applied to the sheet electrode 12 of the charging device D shown in FIG. 4 can be determined, for example, as follows based on the relationship shown in FIG. 44(B) in order to cause the stable discharging at the protruding end portion 121 of the electrode with the voltage V1:

In the charging device D, it is assumed that the discharge start voltage V2th for the sheet electrode 6 is, for example, about −550 V, and the applied voltage V2 is −1000 V. In this case, the following value is obtained from the formula (1):

$$V_{02}=-1000\ \text{V}+550\ \text{V}=-450\ \text{V} \quad (8)$$

Thus, the surface potential $V_{02}$ takes on the value of about −450 V.

The discharge start voltage V1th is determined in accordance with the Paschen's Law. When the discharging gap g' is 50 $\mu$m, the discharge start voltage Vgth, i.e., discharge start voltage V1th is obtained by setting the voltage at the $\alpha$1 point in FIG. 44(B) to the negative polarity, and therefore can be set to about −700 V. By substituting this voltage V1th and the potential $V_{02}$=−450 V of the foregoing formula (8) into the foregoing formula (6), the following relationship is obtained:

$$-450\ \text{V}\leqq \text{V1}+700\ \text{V}$$

BY transforming this, the following formula is obtained:

$$\text{V1}\geqq -1150\ \text{V}$$

The voltage V1 under the above condition is the voltage enabling discharging by the sheet electrode 12 with the discharging gap g' of 50 $\mu$m and, in other words, stable discharging occurs at the protruding end portion 121 of the sheet electrode 12 when voltage V1 is about −1150 V or more.

The values of the discharge enabling voltage with the discharging gap g' of 100 $\mu$m and 150 $\mu$m can be obtained in a similar manner.

When the discharging gap g' is 100 $\mu$m or 150 $\mu$m, the discharge start voltage V1th is obtained by setting the voltage at the β or γ point in FIG. 44(B) to the negative polarity, and is about −1100 V or about −1450 V. By substituting these values and the formula (8) into the formula (6), it can be understood that the voltage V1 satisfies the relationship of V1≧−1550 V or V1≧−1900 V.

Under these conditions, the voltage V1 is the discharge enabling voltage for the sheet electrode 12 in the case of the discharging gap g' of 100 μm or 150 μm. In other words, when the voltage V1 is higher than about −1550 V or about −1900 V, the stable discharging is performed at the protruding end portion 121 of the sheet electrode 12.

The foregoing can be summarized as follows.

In the case where the applied voltage V2 is −1000 V and the discharge start voltage V2th is substantially −550 V, the following relationships are established:

| g' | V1th | V1 |
|---|---|---|
| 50 μm | about −700 V | about −1150 V or more |
| 100 μm | about −1100 V | about −1550 V or more |
| 150 μm | about −1450 V | about −1900 V or more |

The conditions and examples have been described in connection with the charging device D shown in FIG. 4. However, these can be true with respect to charging devices such as devices A2' (FIG. 14), B2' (FIG. 15), C2' (FIG. 16), A2" (FIG. 32), B2" (FIG. 33) or C2" (FIG. 34).

In the charging device shown in FIG. 4, foreign matters such as toner, which passed through an unillustrated cleaning device and others, pass through a space on the contact portion 6*a* of the sheet electrode 6 in contact with the charge target member 9. These foreign matters are subjected to the DC voltage V2 applied to the sheet electrode 6, and thereby are charged to the same polarity as the DC voltage V1, which is applied to the sheet electrode 12. Therefore, contamination of the protruding end portion 121 of the sheet electrode 12 is prevented, and thereby good discharging is allowed.

A total thickness of the insulating sheet 11 and the sheet electrode 6 under the same, and particularly the total thickness of the contact portion 6*a* of the sheet electrode 6, which is in contact with the charge target member 9, and the portion of the insulating sheet 11 near the contact portion 6*a* may be set to 11 μm or more for good charging in accordance with the Paschen's Law, and may be in a range not exceeding 300 μm and more preferably 100 μm or less in view of a relationship between the discharging distance and the ozone production rate. This thickness is uniformed to an extent which does not exert a significant influence on the discharging. The portion having the thickness thus determined acts to maintain a constant distance between the protruding end portion 121 of the sheet electrode 12 and the charge target member 9.

The material of the insulating sheet 11 may be the same as that of the sheet-like charging member 10 in the charging device A shown in FIG. 1.

The contact portion 6*a* of the sheet electrode 6 for contact with the charge target member 9 is preferably made of a material having a good wear resistance and providing a small friction coefficient with respect to the charge target member 9.

The sheet electrodes 12 and 6 have appropriate resistance values, and particularly each preferably has a volume resistivity which is $10^3$ Ω·cm or more for preventing abnormal dot discharging or the like, and thereby performing stable discharging, but does not exceed $10^7$ Ω·cm for preventing an excessively high resistance value requiring application of an excessively high voltage.

The discharging surface of the sheet electrode 12 has a state which is uniformed to an extent not exerting a significant influence on the discharging.

The sheet electrode 6 may be made of a material similar to that of the sheet electrode 12, and therefore may be made of a material which is selected, for example, from a synthetic resin such as a fluorine-contained resin (polytetrafluoroethylene or the like), polyimide, polyester or polyether, and rubber such as urethane rubber, and contains electrically conductive material dispersed therein, although not restricted thereto.

Figure 5:
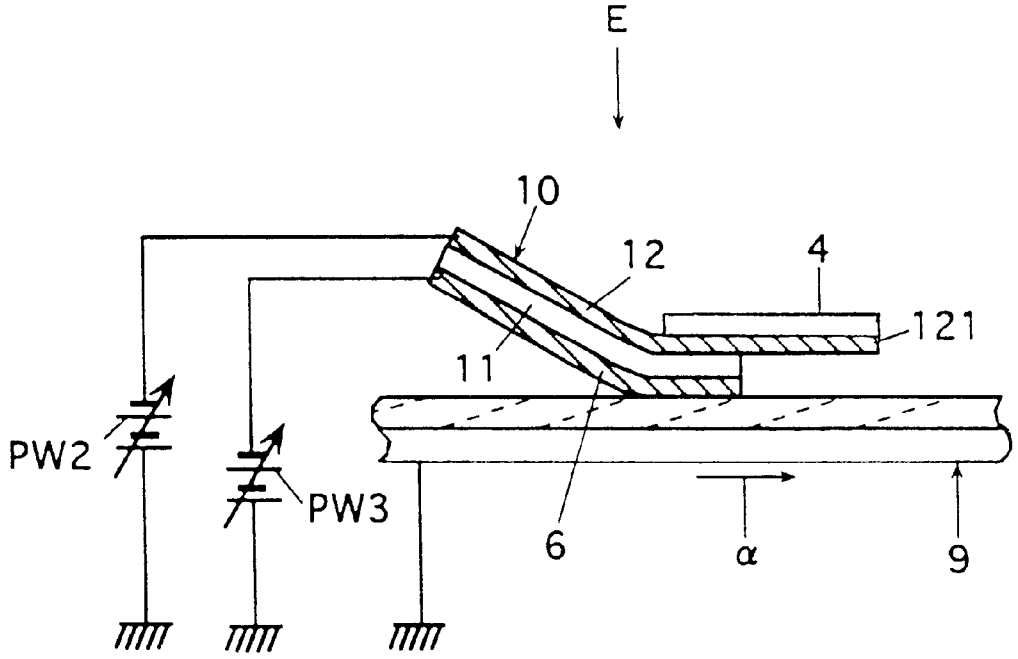

FIG. 5 shows another example of a charging device.

The charging device E shown in FIG. 5 employs a sheet-like charging member, which is similar to the sheet-like charging member 10 provided with the second resistance layer 6 in the charging device D shown in FIG. 4, and is additionally provided with a reinforcing member 4 arranged on the sheet electrode 12 for preventing bending of its downstream protruding end portion 121. In the charging device E shown in FIG. 5, the same parts and portions as those in the device D in FIG. 4 bear the same reference numbers. owing to provision of the reinforcing member 4, the protruding end portion 121 of the sheet electrode 12 is suppressed from being bent toward the charge target member 9 by an electrostatic attraction force when power supply PW2 supplies the voltage to the sheet electrode 12, so that a constant distance is kept between the protruding end portion 121 and the charge target member 9, which enables stable charging.

Figure 6:
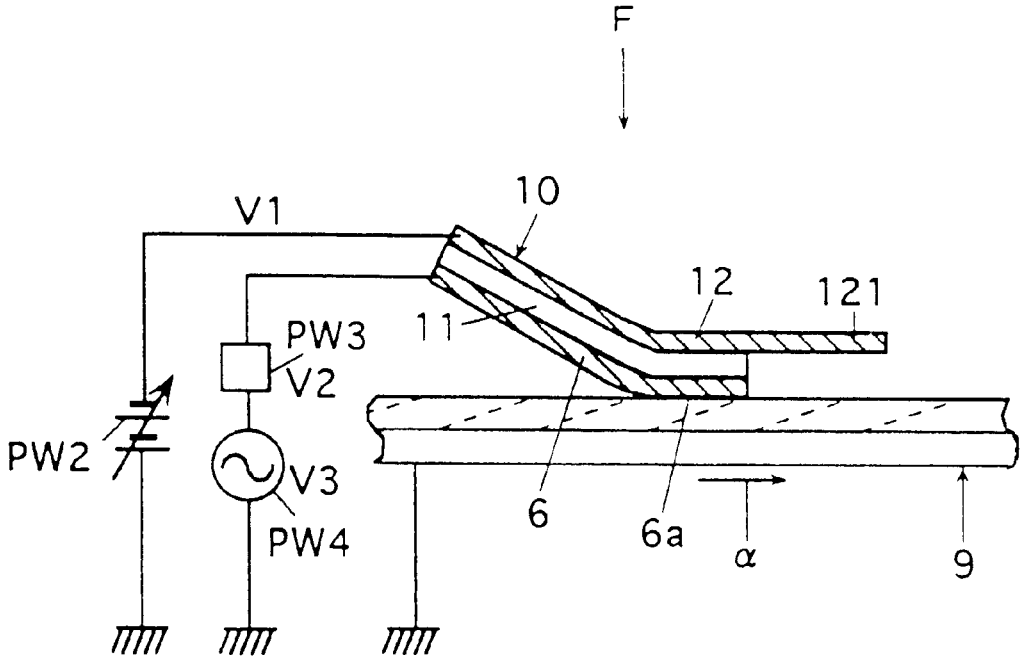

FIG. 6 shows further another example of a charging device.

The charging device F shown in FIG. 6 is similar to the charging device D shown in FIG. 4, and additionally has such a structure that the sheet electrode 6 of the sheet-like charging member 10 is connected to a DC voltage power supply PW3, and is also connected to an alternating voltage power supply (AC power supply in this embodiment) PW4, and the DC voltage V2 and an alternating voltage V3 are applied in a superposed manner to the sheet electrode 6 which is in contact with the charge target member 9.

Figure 7:
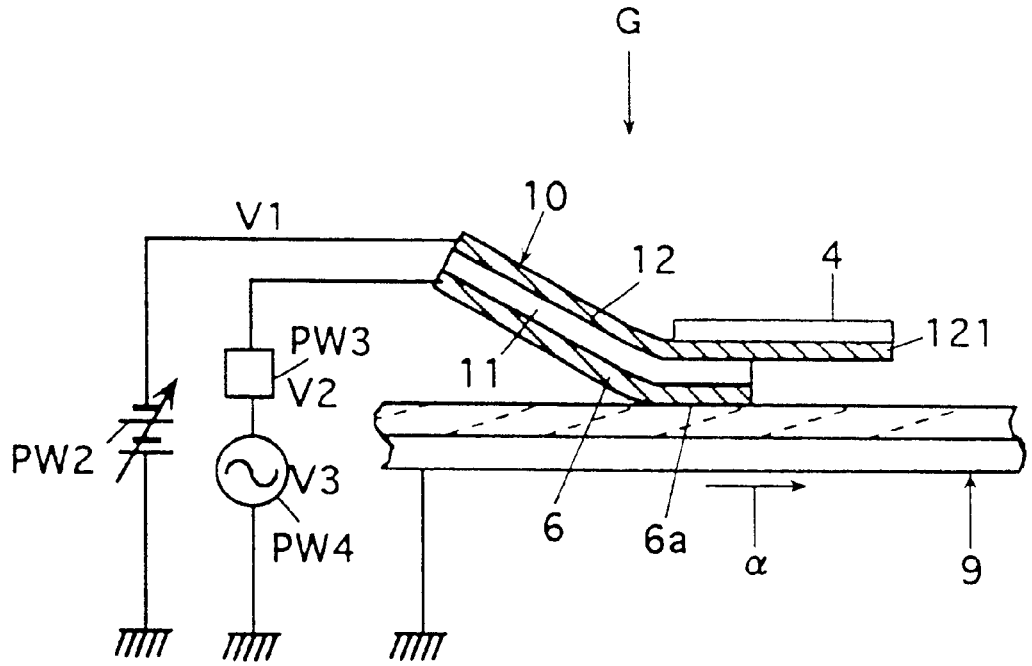

FIG. 7 shows further another example of a charging device.

The charging device G shown in FIG. 7 is similar to the charging device E shown in FIG. 5, and additionally has such a structure that the sheet electrode 6 of the sheet-like charging member 10 is connected to the DC voltage power supply PW3, and is also connected to the alternating voltage power supply (AC power supply in this embodiment) PW4, and the DC voltage V2 and the alternating voltage V3 are applied in a superposed manner to the sheet electrode 6 which is in contact with the charge target member 9.

In each of the charging devices F and G shown in FIGS. 6 and 7, the alternating voltage is applied to the sheet electrode 6, so that an advantage can be achieved as follows. When foreign matters such as toner passed through, e.g., a cleaning device (not shown) and arrive at the sheet-like charging member 10, the foreign matters may be gathered and condensed at a position immediately upstream to the contact portion 6*a* of the charging member (more specifically, sheet electrode 6) in contact with the charge target member 9. Also, the condensed matters may enter the space between the sheet-like charging member 10 and the charge target member 9, and thereby may change a distance between the protruding end portion 121 of the sheet electrode 12 and the charge target member 9. Further, the protruding end portion 121 may be contaminated by the foreign matters. These disadvantages and defective charging caused thereby can be prevented by the application of the alternating voltage described above.

The alternating voltage power supply may be a power supply applying an AC voltage, or may be a power supply applying an oscillating electric field, and more specifically a power supply applying a DC voltage while performing switching (for example, repeating on and off of a pulse voltage, repeating application of a high pulse voltage and a low pulse voltage, or repeating application of positive and negative voltages).

In the embodiments described above, the charge target member is negatively charged. However, the invention may be applied to a structure in which the charge target member is positively charged.

Description will now be given on a charging device A' shown in FIG. 8.

Figure 8:
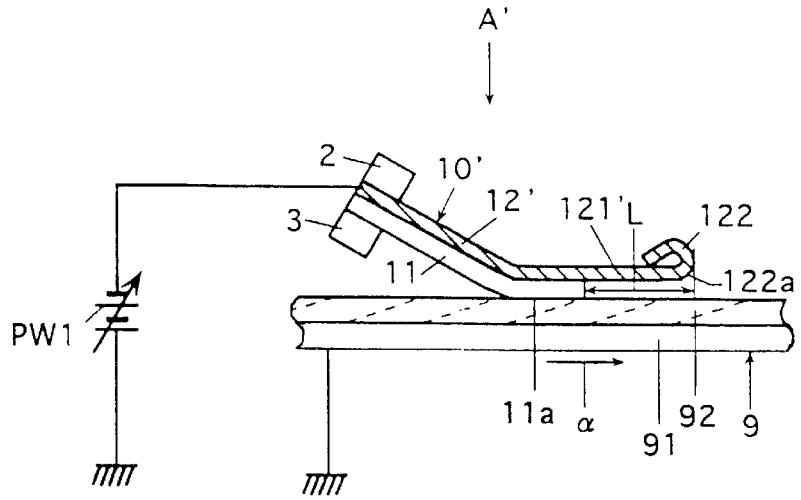

FIG. 8 shows a charging device A' and the charge target member 9 to be charged by the device A'.

The charging device A' includes a sheet-like charging member 10' as well as the holder members 2 and 3 holding the member 10'. The holder members 2 and 3 extend in a direction crossing the surface moving direction α of the charge target member 9. The charging member 10' is held in a cantilever manner by the holder members 2 and 3 holding one end thereof, and a portion of the charging member 10', which is downstream, in the surface moving direction α of the charge target member, to the held end, is brought into surface-contact with the charge target member 9 through a predetermined width. The sheet-like charging member 10' has a width in the direction crossing the surface moving direction α of the charge target member. The charge target member 9 is driven at the surface moving speed Vp (mm/sec).

The sheet-like charging member 10' includes the electric insulating layer (insulating layer) 11 for contact with the charge target member 9, and a first resistance layer 12' which is an electric resistance layer (semiconductor layer) and is layered over the insulating layer 11.

In other words, the insulating layer 11 is the insulating sheet 11, and the first resistance layer 12' is the sheet electrode 12'.

A downstream end portion 121', in the surface moving direction α of the charge target member, of the sheet electrode 12' protrudes in the same direction α from the downstream end of the insulating sheet 11 by a small distance L. A protruding edge 122*a* of the downstream protruding end portion 121' opposed to the charge target member 9 has a curved surface having an arc-shaped section. This arc-shaped curved surface is formed by roundly folding back the protruding end 122 away from the charge target member 9. The foregoing protrusion distance L (mm) of the protruding end portion 121' is set to attain the proximity discharging time T (=L/Vp) in a range from 0.005 to 0.1 sec.

The sheet electrode 12' is connected to the DC power supply PW1, and the power supply PW1 can apply a DC voltage of, e.g., −1500 V to the sheet electrode 12'.

By application of the voltage to the sheet electrode 12', discharging occurs at the downstream protruding end portion 121', so that the surface of the charge target member 9 is substantially uniformly charged to a voltage, e.g., from −600 V to −900 V.

The charge target member 9 is the same as that shown in FIG. 1.

The thickness of the insulating sheet 11, and particularly the thicknesses of a contact portion 11*a* of the insulating sheet 11 to be in contact with the charge target member 9 may be set to 11 μm or more for good charging in accordance with the Paschen's Law, and may be in a range not exceeding 300 μm and more preferably 100 μm or less in view of a relationship between the discharging distance and the ozone production rate. The thickness of the insulating sheet 11 is uniformed to an extent which does not exert a significant influence on the discharging. According to the above range, the portion having the above thickness maintains a constant distance between the downstream protruding end portion 121' of the sheet electrode 12', which is supplied with the discharging voltage and thereby performs the discharging, and the charge target member 9.

The material of the insulating sheet 11 may be similar to that of the insulating sheet 11 of the charging member 10 shown in FIG. 1.

The contact portion 11*a* of the insulating sheet 11 for contact with the charge target member 9 is preferably made of a material which has a high wear resistance and provides a small friction coefficient with respect to the charge target member 9.

The sheet electrode 12' has an appropriate resistance value, and particularly a volume resistivity in a range from $10^3$ Ω·cm to $10^7$ Ω·cm similarly to the charging member 10 shown in FIG. 1.

The discharging surface of the sheet electrode 12' is uniformed to an extent not exerting a significant influence on the discharging.

The sheet electrode 12' may be made of a material similar to that of the sheet electrode 12 shown in FIG. 1 According to the charging device A' described above, the sheet-like charging member 10' is brought into surface-contact with the moving surface of the charge target member 9 through a predetermined width. In this operation, the insulating sheet 11 comes into contact with the charge target member 9, and the sheet electrode 12' over the same is supplied with a DC voltage from the power supply PW1, so that the surface of the charge target member 9 is charged.

Foreign matters arrive at the sheet-like charging member 10' in accordance with movement of the surface of the charge target member 9. These foreign matters are stopped and held by the contact portion 11*a* of the insulating sheet 11 in contact with the charge target member 9.

The sheet electrode 12' has the downstream protruding end portion 121' which protrudes from the insulating sheet 11 and is not in contact with the charge target member 9. This downstream protruding end portion 121' actually performs the discharging, and keeps a constant discharging space equal to at least the thickness of the insulating sheet 11 with respect to the charge target member 9. Further, the protruding end 122 has the protruding edge 122*a* having a curved surface of an arc-shaped section.

As described above, the foreign matters which arrived at the position in accordance with movement of the surface of the charge target member 9 are held at the position, and a constant distance is maintained between the sheet electrode 12' performing the discharging and the charge target member 9, so that irregular charging is suppressed, and good charging is performed.

Even if the foreign matters which were held at an upstream position pass through a space on the sheet-like charging member 10' and arrive at the position of the protruding end portion 121' of the sheet electrode 12', the discharging occurs at the protruding end portion 121', and the foreign matters rapidly move through the above position in accordance with the movement of the surface of the charge target member. This enables uniform charging. Since the protruding edge 122*a'* of the protruding end portion 121' has the curved surface of an arc-shaped section, concentration of charges at the protruding edge 122*a*' is prevented, so that abnormal discharging at the protruding end portion 121' and therefore irregular charging of the charge target member 9 can be prevented.

Figure 9:
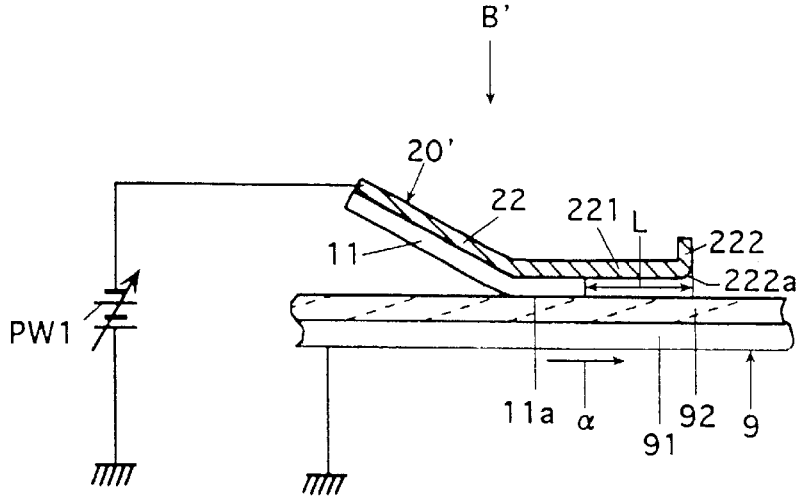
Figure 10:
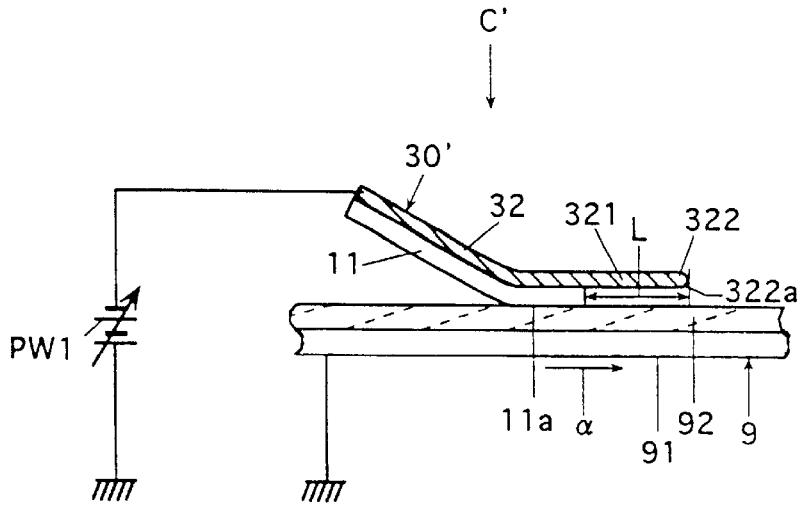

FIGS. 9 and 10 show modifications of the charging device shown in FIG. 8.

The charging device B' shown in FIG. 9 is similar to the charging device A' shown in FIG. 8, but employs a sheet-like charging member 20' using a sheet electrode 22 instead of the sheet electrode 12' in the sheet-like charging member 10'. A protruding edge (convex corner of the bent portion in this embodiment) 222*a* of a protruding end portion 221 of the sheet electrode 22 has a curved surface having an arc-shaped section, which is formed by bending a protruding end 222 of the protruding end portion 221 away from the charge target member 9.

The charging device C' shown in FIG. 10 is similar to the charging device A' shown in FIG. 8, but employs a sheet-like charging member 30' using a sheet electrode 32 instead of the sheet electrode 12' in the sheet-like charging member 10'. A protruding edge 322*a* of the protruding end portion 321 of the sheet electrode 32 opposed to the charge target member 9 has a curved surface having an arc-shaped section, which is obtained by effecting working or processing on the protruding end 322 itself to have the curved edge surface of the arc-shaped section.

In this charging devices B' and C', the same parts and portions as those of the device A' shown in FIG. 8 bear the same reference numbers. The holder members 2 and 3 are used for supporting the charging member, but they are not shown in FIGS. 9 and 10. This is also true with respect to FIGS. 11 through 25 showing other examples which will be described later.

The materials, resistance values and others of the sheet electrodes 22 and 32 shown in FIGS. 9 and 10 are similar to those of the sheet electrode 12' shown in FIG. 8.

Then, the charging devices shown in FIGS. 9 and 10 will be described below.

In these charging devices B' and C', each of the sheet-like charging members 20' and 30' is brought into surface-contact with the moving surface of the charge target members 9 through a predetermined width, respectively. In this operation, the insulating sheet 11 comes into contact with the charge target member 9, and the power supply PW1 supplies the DC voltage to the sheet electrode 22 or 32, so that the surface of each charge target member 9 is charged.

The foreign matters, which arrived at the sheet-like charging member 20' or 30' in accordance with movement of the surface of the charge target member, 9 are stopped and held at the contact portion 11*a* of the insulating sheet 11 of the charging member 20' or 30' for contact with the charge target member 9. Each of the downstream end portions 221 and 321 of the sheet electrode 22 and 32, which is not in contact with the charge target member 9 and protrudes from the insulating sheet 11, causes the charging, and also keep a constant discharging space equal to at least the thickness of the insulating sheet 11 with respect to the charge target member 9. Further, each of the protruding edge 222*a* and 322*a* of the protruding end portions 221 and 321 has a curved surface having an arc-shaped section.

Either of the charging devices B' and C' can achieve the effect similar to that by the charging device A'.

Figure 11:
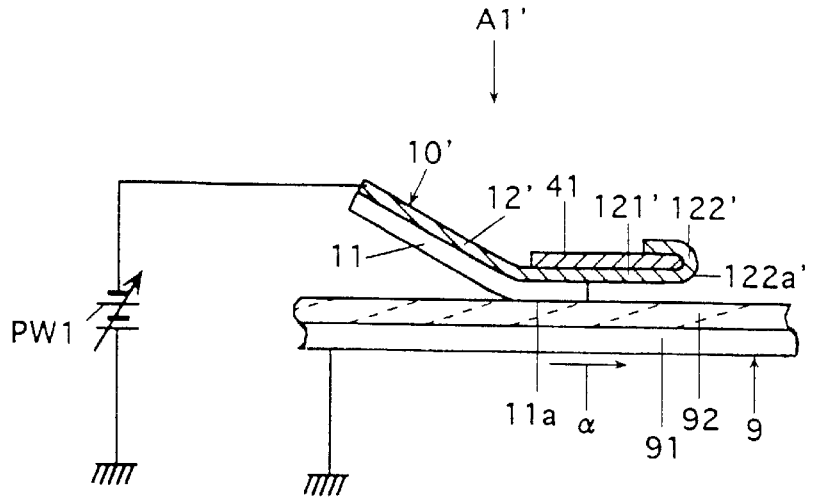
Figure 12:
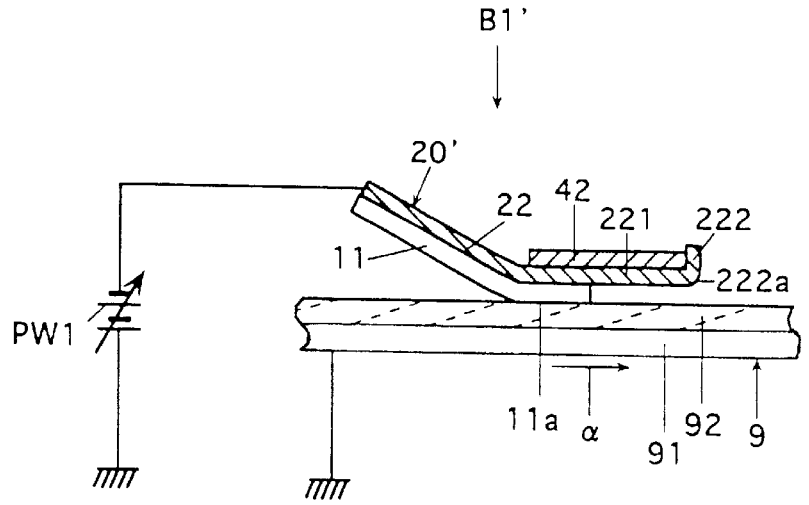
Figure 13:
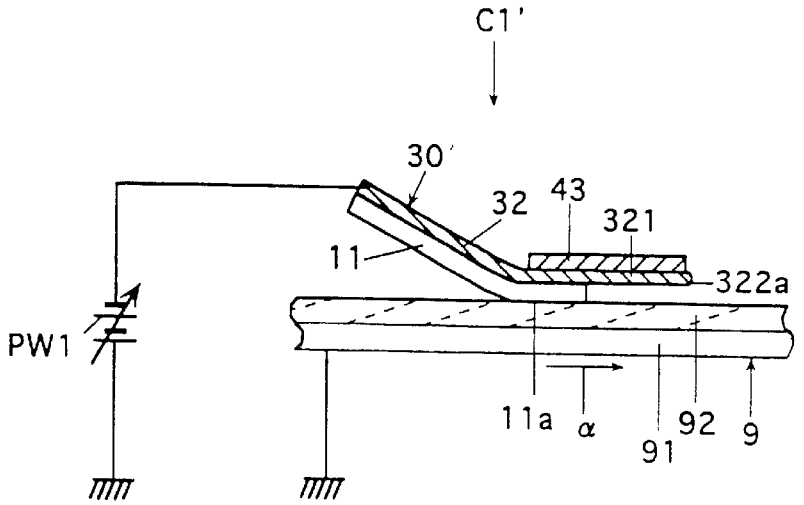

FIGS. 11 to 13 show modifications of the charging devices shown in FIGS. 8 to 10, respectively. Charging devices A1', B1' and C1' shown in FIGS. 11 to 13 employ charging members, which are similar to the charging members 10', 20' and 30' of the charging devices A', B' and C' shown in FIGS. 8 to 10, but are additionally provided with reinforcing layers 41, 42 and 43 arranged on the sheet electrodes 12', 22 and 32 for preventing bending of the downstream protruding end portions 121', 221 and 321, respectively. In the charging device A1', the protruding end 122' of the sheet electrode 12' of the sheet-like charging member 10' is roundly folded back and is located over the reinforcing layer 41. In the charging devices shown in FIGS. 11 to 13, the same parts and portions as those shown in FIGS. 8 to 10 bear the same reference numbers. The charging devices A1', B1' and C1' shown in FIGS. 11 to 13 will be further described below.

As shown in FIGS. 11 to 13, provision of the reinforcing layers 41, 42 and 43 suppresses bending of the protruding end portions 121', 221 and 321 of the sheet-like electrodes toward the charge target member 9 by the electrostatic attraction forces, respectively, when the sheet electrodes 12', 22 and 32 are supplied with the voltages from the power supplies PW1. Thereby, a constant distance is kept between the charge target member 9 and each of the protruding end portions 121', 221 and 321, and therefore stable charging can be performed. In addition to provision of the reinforcing layers 41, 42 and 43 at the sheet electrodes 12', 22 and 32, the thicknesses of the sheet electrodes 12', 22 and 32 themselves may be increased.

Figure 14:
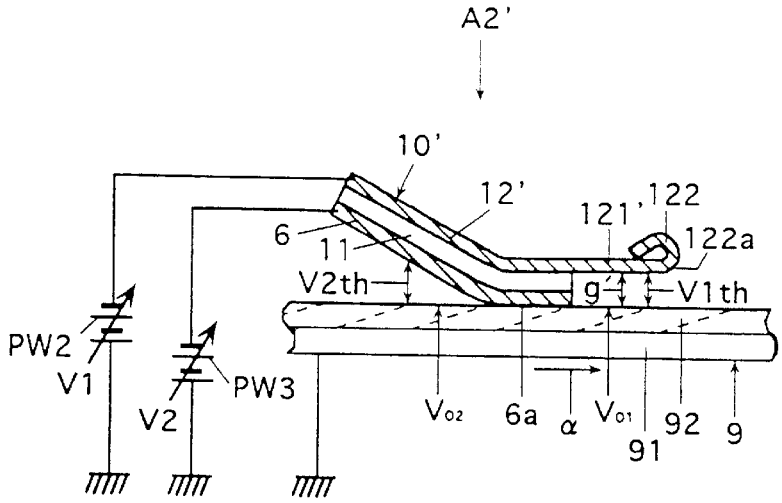
Figure 15:
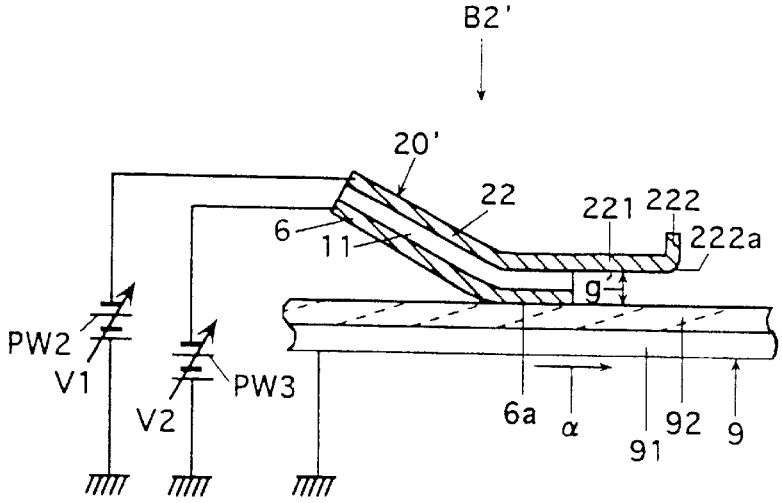
Figure 16:
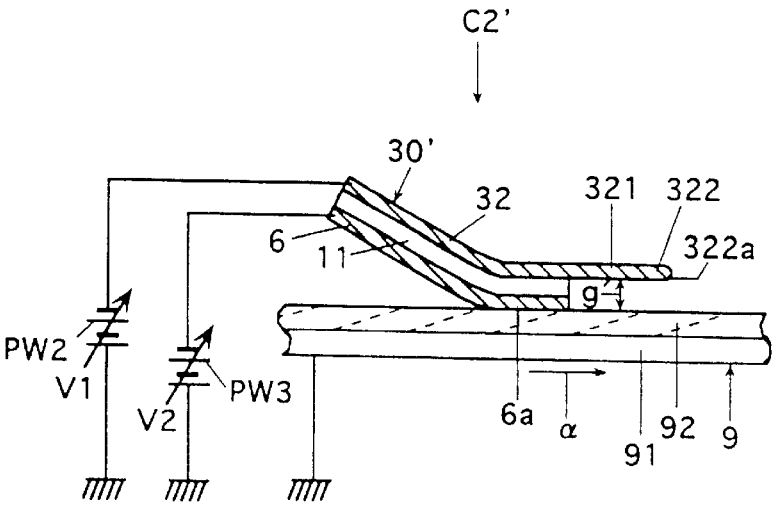

FIGS. 14 to 16 show further modifications of the charging devices shown in FIGS. 8 to 10, respectively.

Charging devices A2', B2' and C2' shown in FIGS. 14 to 16 employ sheet-like charging members which are similar to the sheet-like charging members 10', 20' and 30' of the charging devices A', B' and C' shown in FIGS. 8 to 10, respectively, but each are provided with the sheet electrode 6 arranged on the lower surface of the insulating sheet 11. This sheet electrode 6 is in contact with the charge target member 9, is made of an electric resistance layer (semiconductor layer) and serves as a second resistance layer. In FIGS. 14 to 16, the same parts and portions as those shown in FIGS. 8 to 10 bear the same reference numbers. The charging devices A2', B2' and C2' shown in FIGS. 14 to 16 will be further described below.

As shown in FIGS. 14 to 16, the sheet electrodes 12', 22 and 32 on the insulating sheets 11 each are connected to the power supply PW2, and can be supplied with the DC voltage V1 therefrom. Also, each sheet electrode 6 is connected to the DC power supply PW3, and can be supplied with the DC voltage V2 of the same polarity as the voltage V1.

Each of the protruding end portions 121', 221 and 321 of the sheet electrodes 12', 22 and 32 maintains a constant discharging space g', which is equal to at least a total thickness of the insulating sheet 11 and the sheet electrode 6 under the same, with respect to the charge target member 9.

In these devices A2', B2' and C2', the sheet electrodes 6 are supplied with the voltages V2, so that the sheet-like charging members 10', 20' and 30' are electrostatically adhered onto the charge target members 9, respectively. Thereby, each of the sheet-like charging members 10', 20' and 30' can follow the charge target member in a desired manner without an influence by waving or vibration caused, e.g., by variation in surface moving speed of the charge target member, and the distance between the charge target member 9 and each of the sheet electrodes 12', 22 and 32 can be stably maintained.

The voltage V1 applied to each of the sheet electrodes 12', 22 and 32 may preferably take on the value which causes stable charging at the protruding end portion 121', 221 and 321. The conditions for enabling the stable discharging are similar to those already described in connection with the charging device D shown in FIG. 4. Similarly to the charging device D shown in FIG. 4, V1th in FIG. 14 represents the discharge start voltage on the sheet electrode 12' supplied with the voltage V1, V2th represents the discharge start voltage on the sheet electrode 6 supplied with the voltage V2, $V_{01}$ represents the surface potential of the charge target member 9 charged by the protruding end portion 121' of the sheet electrode 12', and $V_{02}$ represents the surface potential of the charge target member 9 charged by the sheet electrode 6.

In each of the charging devices A2', B2' and C2' shown in FIGS. 14 to 16, foreign matters such as toner, which passed through, e.g., a cleaning device (not shown), come to a position on the contact portion 6*a* of the sheet electrode 6 in contact with the charge target member 9. These foreign matters are charged by the DC voltage V2 applied to the sheet electrode 6 to have the same polarity as the DC voltage V1 applied to the sheet electrode 12', 22 or 32. Therefore, contamination of the protruding end portions 121', 221 and 321 of the sheet electrodes 12', 22 and 32 are prevented, respectively. Therefore, good charging can be performed.

The total thickness of the insulating sheet 11 and the sheet electrode 6 under the same, and particularly the total thicknesses of at least the contact portion 6*a* of the sheet electrode 6 to be in contact with the charge target member 9 and a portion of the insulating layer 11 near the contact portion 6*a* may be set to 11 $\mu$m or more for good charging in accordance with the Paschen's Law, and may be in a range not exceeding 300 $\mu$m and more preferably 100 $\mu$m or less in view of a relationship between the discharging distance and the ozone production rate. This total thickness of the above portions is uniformed to an extent which does not exert a significant influence on the discharging. The portion having the above thickness maintains a constant distance between the charge target member 9 and each of the protruding end portions 121', 221 and 321 of the sheet electrodes 12', 22 and 32.

The material of the insulating sheet 11 is similar to that of the sheet-like charging member, e.g., in the charging device A' in FIG. 8.

The contact portion 6*a* of the sheet electrode 6 for contact with the charge target member 9 is preferably made of a material which has a high wear resistance and provides a small friction coefficient with respect to the charge target member 9.

The sheet electrodes 12', 22 and 32 as well as the sheet electrode 6 each have an appropriate resistance value, and particularly a volume resistivity in a range from $10^3$ Ω·cm to $10^7$ Ω·cm.

The discharging surface of each of the sheet electrodes 12', 22 and 32 is uniformed to an extent not exerting a significant influence on the discharging.

The sheet electrode 6 may be made of a material similar to that of the sheet electrode 6 in the charging device D shown in FIG. 4.

Figure 17:
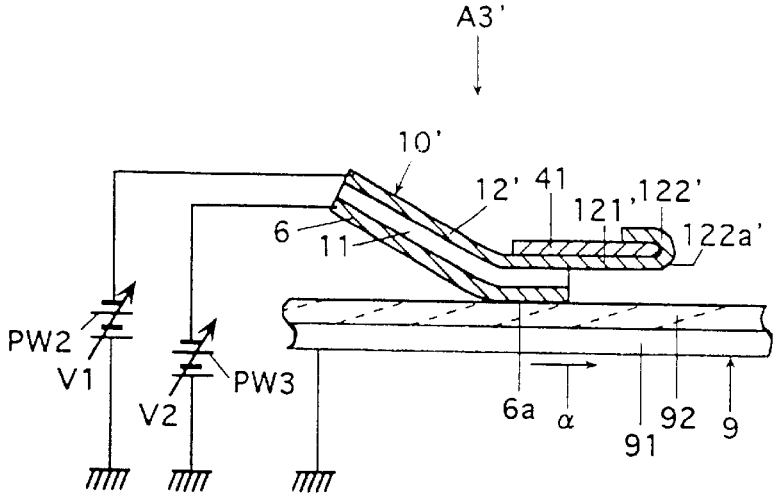
Figure 18:
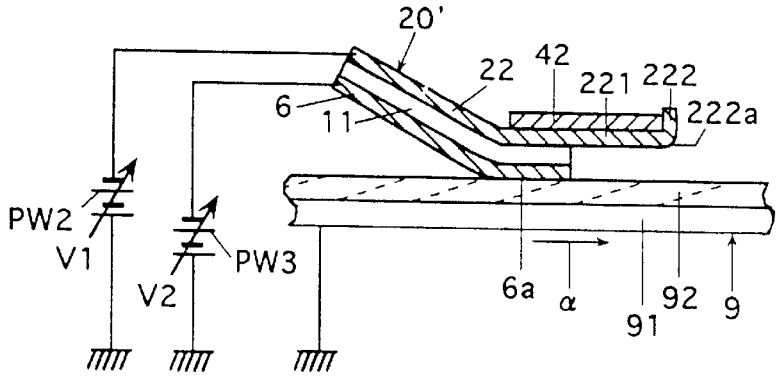
Figure 19:
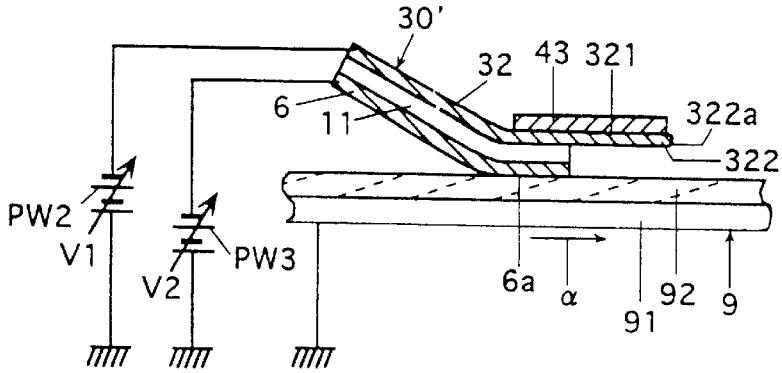

FIGS. 17 to 19 show further modifications of the charging devices shown in FIGS. 14 to 16, respectively.

Charging devices A3', B3' and C3' shown in FIGS. 17 to 19 employ sheet-like charging members which are similar to the sheet-like charging members 10', 20' and 30' of the charging devices A2', B2' and C2' shown in FIGS. 14 to 16, respectively, but are additionally provided with reinforcing layers 41, 42 and 43 arranged on the downstream protruding end portions 121', 221 and 321 of the sheet electrodes 12', 22 and 32, respectively. In FIGS. 17 to 19, the same parts and portions as those shown in FIGS. 14 to 16 bear the same reference numbers. The charging devices A3', B3' and C3' shown in FIGS. 17 to 19 will be further described below.

In these charging devices A3', B3' and C3', provision of the reinforcing layers 41, 42 and 43 suppresses bending of the protruding end portions 121', 221 and 321 of the sheet-like electrodes toward the charge target member 9 by the electrostatic attraction forces, respectively, when the sheet electrodes 12', 22 and 32 are supplied with the voltages from the power supplies PW2. Thereby, a constant distance is kept between the charge target member 9 and each of the protruding end portions 121', 221 and 321, and therefore stable charging can be performed. Instead of or in addition to provision of the reinforcing layers 41, 42 and 43 at the sheet electrodes 12', 22 and 32, the thicknesses of the sheet electrodes 12', 22 and 32 themselves may be increased.

Figure 20:
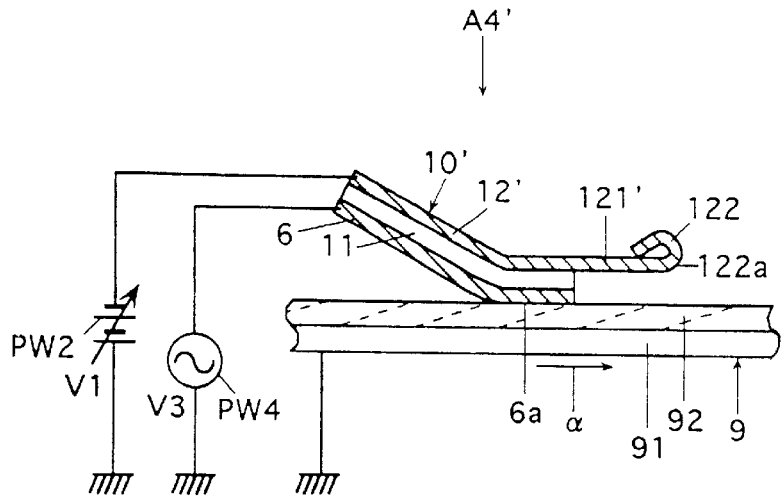
Figure 21:
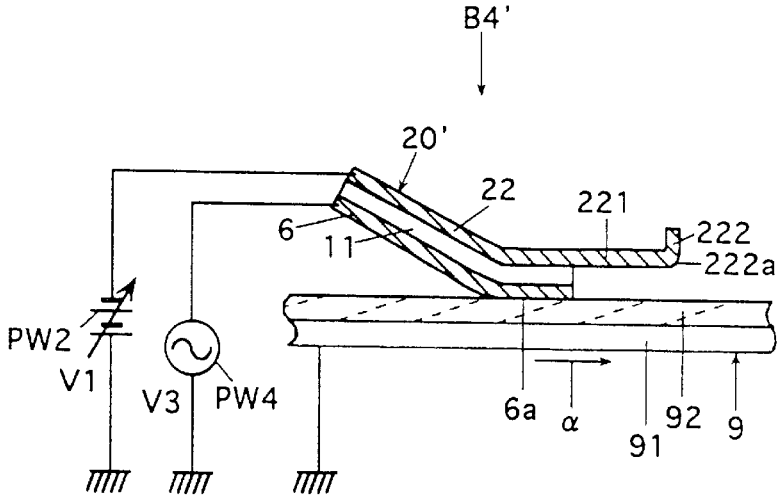
Figure 22:
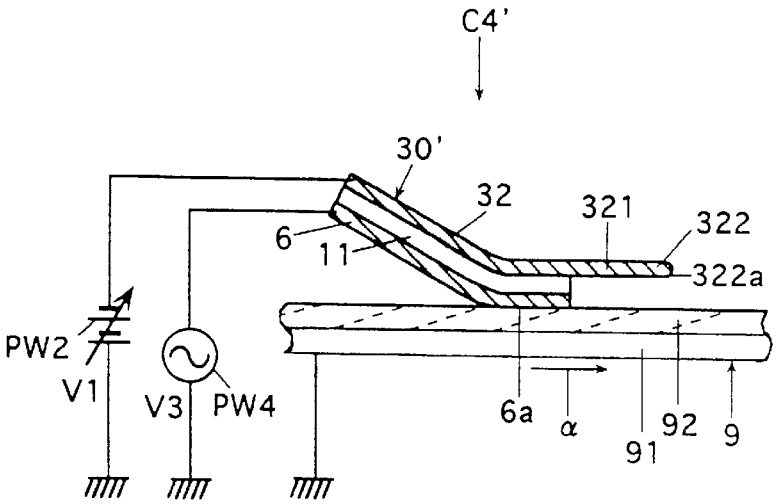

FIGS. 20 to 22 show further modifications of the charging devices shown in FIGS. 14 to 16, respectively.

Charging devices A4', B4' and C4' shown in FIGS. 20 to 22 are similar to the charging devices A2', B2' and C2' shown in FIGS. 14 to 16, respectively, but each employ, instead of the DC voltage power supply PW3, an alternating voltage power supply (AC voltage in these modifications) which is connected to the sheet electrode 6 of the sheet-like charging member 10', 20' or 30' for applying the alternating voltage V3 to the sheet electrode 6 in contact with the charge target member 9.

In the charging devices shown in FIGS. 20 to 22, the same parts and portions as those shown in FIGS. 14 to 16 bear the same reference numbers.

Figure 23:
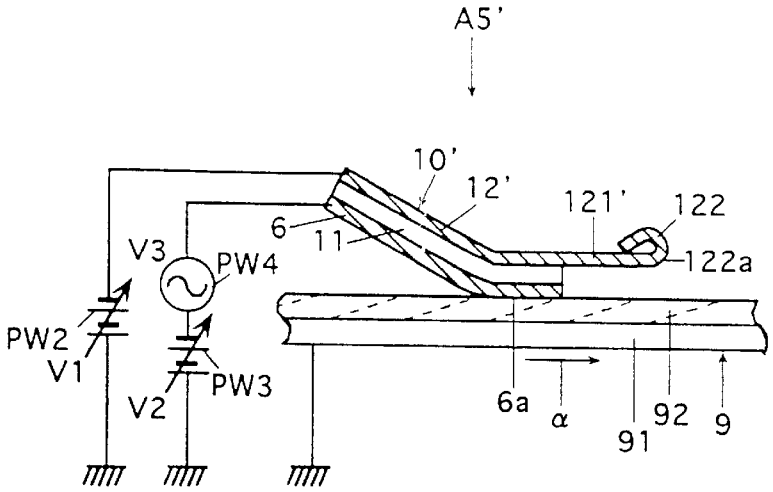
Figure 24:
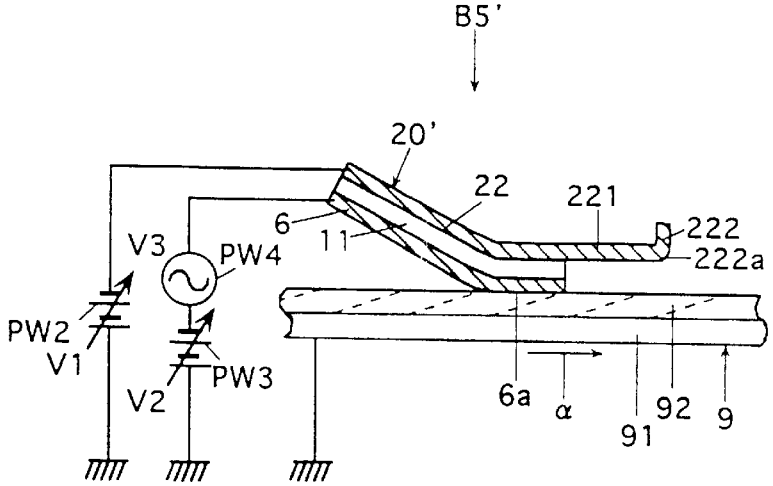
Figure 25:
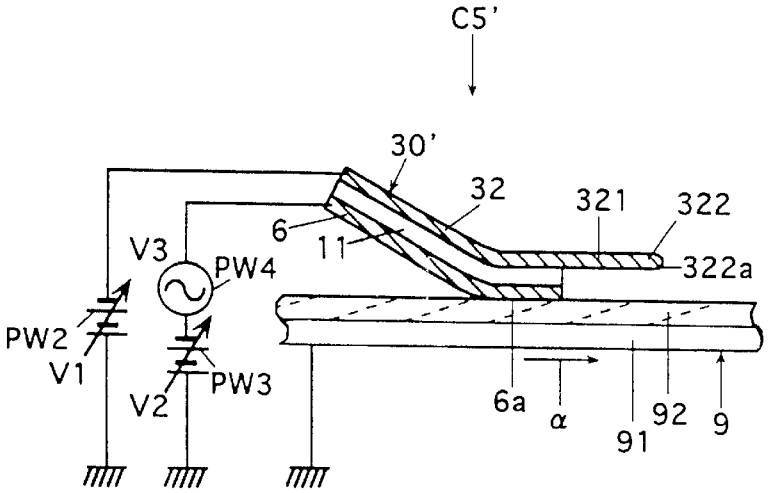

Charging devices A5', B5' and C5' shown in FIGS. 23 to 25 are similar to the charging devices A2', B2' and C2' shown in FIGS. 14 to 16, respectively, but each employ, in addition to the DC voltage power supply PW3, an alternating voltage power supply PW4 which is connected to the sheet electrode 6 of the sheet-like charging member 10', 20' or 30' for applying the DC voltage V2 and the alternating voltage V3 in a superposed manner to the sheet electrode 6 in contact with the charge target member 9. In the charging devices shown in FIGS. 23 to 25, the same parts and portions as those shown in FIGS. 14 to 16 bear the same reference numbers. The charging devices shown in FIGS. 20 to 25 will be further described below.

In the charging devices A4', B4' and C4' shown in FIGS. 20 to 22, the sheet electrodes 6 are supplied with the alternating voltages. Also, in the charging devices A5', B5' and C5' shown in FIGS. 23 to 25, the electrodes 6 are supplied with the DC voltages and the alternating voltages in a superposed manner. Owing to this, the following disadvantages can be prevented. Foreign matters, which passed through, e.g., an unillustrated cleaning device, may arrive at the sheet-like charging member 10', 20' or 30', and thereby are gathered and condensed at a position immediately upstream to the contact portion 6*a* of the charging member (more specifically, sheet electrode 6) in contact with the charge target member 9. Also, the condensed matters may enter the space between the sheet-like charging member 10', 20' or 30' and the charge target member 9, and thereby may change a distance between the protruding end portion 121', 221 or 321 of the sheet electrode 12', 22 or 32 and the charge target member 9. Further, the protruding end portion 121', 221 or 321 may be contaminated by the foreign matters. These disadvantages and defective charging caused thereby can be prevented by the application of the alternating voltage or the application of the DC voltages and the alternating voltages in a superposed manner described above.

The alternating voltage power supply may be a power supply applying an AC voltage, or a power supply applying a DC voltage while performing switching (for example, switching with pulse voltages, switching of high and low voltages, or switching of positive and negative voltages) for providing an oscillating electric field.

Description will now be given on a charging device A" shown in FIG. 26.

Figure 26:
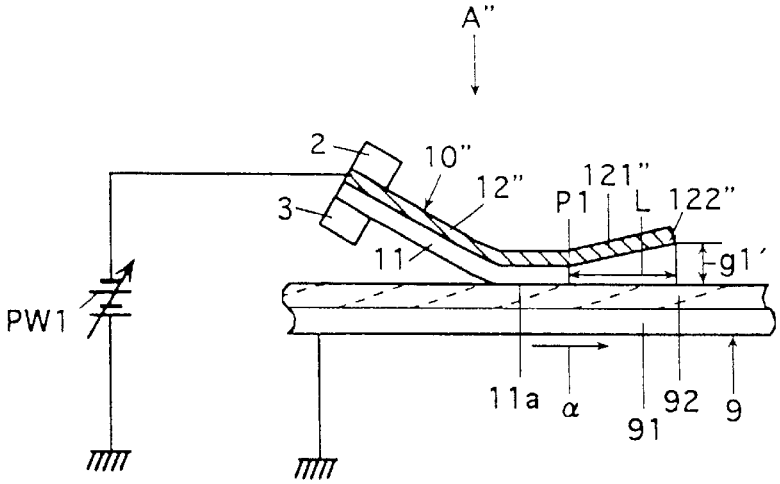

FIG. 26 shows a charging device A" and the charge target member 9 to be charged by the device A".

The charging device A" shown in FIG. 26 includes a sheet-like charging member 10" as well as the holder members 2 and 3 holding the member 10". The holder members 2 and 3 extend in a direction crossing the surface moving direction α of the charge target member 9. The charging member 10"is held in a cantilever manner by the holder members 2 and 3 holding one end thereof, and a portion of the charging member 10", which is downstream, in the surface moving direction α of the charge target member, to the held end, is brought into surface-contact with the charge target member 9 through a predetermined width. The sheet-like charging member 10" has a width in the direction crossing the surface moving direction α of the charge target member. The charge target member 9 is driven at the surface moving speed Vp (mm/sec).

The sheet-like charging member 10" includes the electric insulating layer 11 for contact with the charge target member 9, and a first resistance layer 12" which is an electric resistance layer (semiconductor layer) and is layered over the insulating layer 11.

In other words, the insulating layer 11 is the insulating sheet 11, and the first resistance layer 12" is the sheet electrode 12".

A downstream end portion 121", in the surface moving direction α of the charge target member, of the sheet electrode 12" protrudes in the same direction α from the downstream end of the insulating sheet 11 by a small distance L. The downstream protruding end portion 121" from a portion above the insulating sheet 11 at point P9 to the protruding end 122" is inclined to extend away from the charge target member 9. More specifically, a distance g1' between the protruding edge 122' of the protruding end portion 121" and the charge target member 9 is larger than the minimum distance between the sheet electrode 12" and the charge target member 9, and is set to a value which does not cause discharging from the protruding end 122" to the charge target member 9. The foregoing protrusion distance L (mm) of the protruding end portion 121" is set to attain the proximity discharging time T (=L/Vp) in a range from 0.005 to 0.1 sec.

The sheet electrode 12" is connected to the DC power supply PW1, and the power supply PW1 can apply a DC voltage of, e.g., −1500 V to the sheet electrode 12".

By application of the voltage to the sheet electrode 12", discharging occurs at the downstream protruding end portion 121", so that the surface of the charge target member 9 is substantially uniformly charged to a voltage, e.g., from −600 V to −900 V.

The charge target member 9 is the same as that shown in FIG. 1.

The thickness of the insulating sheet 11, and particularly the thicknesses of a contact portion 11*a* of the insulating sheet 11 to be in contact with the charge target member 9 and a portion near the contact portion 11*a* may be set to 11 μm or more for good charging in accordance with the Paschen's Law, and may be in a range not exceeding 300 μm and more preferably 100 μm or less in view of a relationship between the discharging distance and the ozone production rate. The thickness of the insulating sheet 11 is uniformed to an extent which does not exert a significant influence on the discharging. According to the above range, the portion having the above thickness maintains a constant distance between the downstream protruding end portion 121" of the sheet electrode 12", which is supplied with the discharging voltage and thereby performs the discharging, and the charge target member 9.

The material of the insulating sheet 11 may be similar to that of the insulating sheet in the charging device A shown in FIG. 1.

The contact portion 11*a* of the insulating sheet 11 for contact with the charge target member 9 is preferably made of a material which has a high wear resistance and provides a small friction coefficient with respect to the charge target member 9.

The sheet electrode 12" has an appropriate resistance value, and particularly a volume resistivity in a range from $10^3$ Ω·cm to $10^7$ Ω·cm.

The discharging surface of the sheet electrode 12" is uniformed to an extent not exerting a significant influence on the discharging.

The sheet electrode 12" may be made of a material similar to that of the sheet electrode 12 in the charging device A shown in FIG. 1

According to the charging device A" described above, the sheet-like charging member 10" is brought into surface-contact with the moving surface of the charge target member 9 through a predetermined width. In this operation, the insulating sheet 11 comes into contact with the charge target member 9, and the sheet electrode 12" over the same is supplied with a DC voltage from the power supply PW1, so that the surface of the charge target member 9 is charged.

Foreign matters arrive at the sheet-like charging member 10" in accordance with movement of the surface of the charge target member 9. These foreign matters are stopped and held by the contact portion 11*a* of the insulating sheet 11 in contact with the charge target member 9.

The sheet electrode 12" has the downstream protruding end portion 121" which protrudes from the insulating sheet 11 and is not in contact with the charge target member 9. This downstream protruding end portion 121" actually performs the discharging, and keeps a constant discharging space equal to at least the thickness of the insulating sheet 11 with respect to the charge target member 9. Further, the protruding end portion 121" has the protruding end 122" spaced from the charge target member 9 by the distance g1' not causing the discharging to the charge target member 9.

As described above, the foreign matters which arrived at a position in accordance with movement of the surface of the charge target member 9 are held at the position, and a constant distance is maintained between the sheet electrode 12" performing the discharging and the charge target member 9, so that irregular charging is suppressed, and good charging is performed.

Even if the foreign matters which were held at an upstream position pass through a space on the sheet-like charging member 10" and arrive at the position of the protruding end portion 121" of the sheet electrode 12", the discharging occurs at the protruding end portion 121", and the foreign matters rapidly move through the above position in accordance with the movement of the surface of the charge target member. This enables uniform charging. Since the protruding end 122" of the protruding end portion 121" is spaced from the charge target member 9 by the distance g1' not causing the charging to the charge target member 9, abnormal discharging at the protruding end portion 121" and therefore irregular charging of the charge target member 9 can be prevented.

Figure 27:
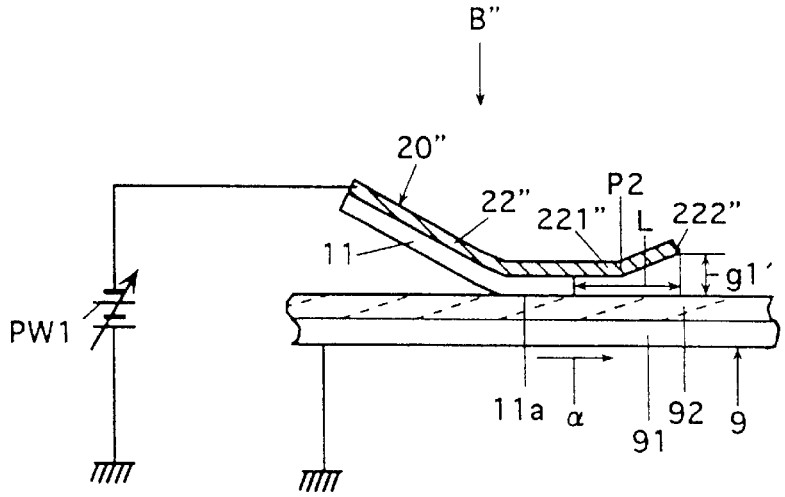
Figure 28:
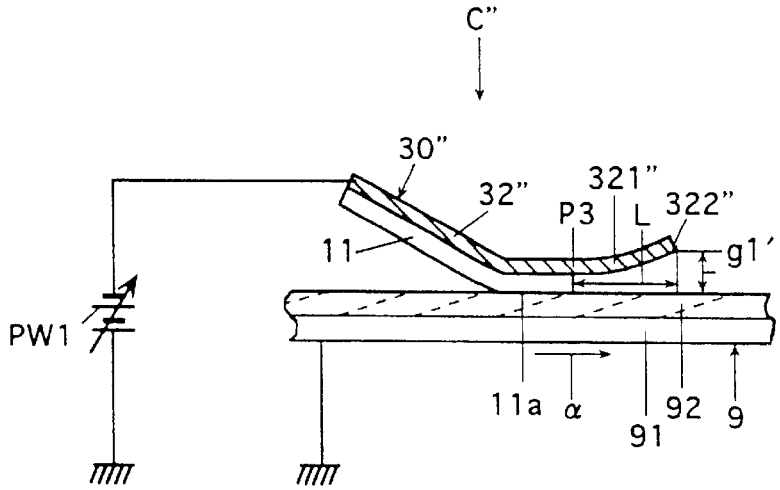

FIGS. 27 and 28 show modifications of the charging device shown in FIG. 26.

The charging device B" shown in FIG. 27 is similar to the charging device A" shown in FIG. 26, but employs a sheet-like charging member 20" using a sheet electrode 22" instead of the sheet electrode 12" in the sheet-like charging member 10". A protruding end portion 221" of the sheet electrode 22" protruding from the insulating sheet 11 has a portion which extends from its intermediate portion P2 to a protruding end 222" and is inclined in a diverging manner with respect to the charge target member 9. A distance g1' between the protruding end 222" and the charge target member 9 is set to a value which does not cause discharging.

A charging device C" shown in FIG. 28 is similar to the charging device A" shown in FIG. 26, but is provided with a sheet-like charging member 30" using a sheet electrode 32" instead of the sheet-like charging member 10" using the sheet electrode 12" in the charging device A" shown in FIG. 26. The sheet electrode 32" has a portion, which is defined between a portion P3 on the insulating sheet 11 and a protruding end 322", and has an arc-shaped form extending in a diverging manner with respect to the charge target member 9. The distance g1' between the protruding end 322" and the charge target member 9 is set to a value not causing the discharging.

In the charging devices shown in FIGS. 27 and 28, the same parts and portions as those shown in FIG. 26 bear the same reference numbers. The holder members 2 and 3 are used for supporting the charging member, but they are not shown in FIGS. 27 and 28. This is also true with respect to charging devices which will be described later.

The sheet electrodes 22", and 32" shown in FIGS. 27 and 28 may be made of a material similar to that of the sheet electrode 12" shown in FIG. 26.

The charging devices shown in FIGS. 27 and 28 will be described below.

In each of the charging devices B" and C", the sheet-like charging member 20" or 30" is brought into surface-contact with the moving surface of the charge target member 9 through a predetermined width. In this operation, the insulating sheet 11 comes into contact with the charge target member 9, and the sheet electrode 22" or 32" over the same is supplied with a DC voltage from the power supply PW1, so that the surface of the charge target member 9 is charged.

Foreign matters arrive at the sheet-like charging member 20", or 30" in accordance with movement of the surface of the charge target member 9. These foreign matters are stopped and held by the contact portion 11*a* of the charging member 20" or 30" (more specifically, insulating sheet 11) in contact with the charge target member 9. Each of the sheet electrodes 22" and 32" has the downstream protruding end portion 221" or 321" which protrudes from the insulating sheet 11 and is not in contact with the charge target member 9. Each of the downstream protruding end portions 221" and 321" actually performs the discharging, and keeps a constant discharging space equal to at least the thickness of the insulating sheet 11 with respect to the charge target member 9. Further, each of the protruding end portions 221" and 321" has the protruding end 222" or 322" spaced from the charge target member 9 by the distance g1' not causing the discharging to the charge target member 9.

Both the charging devices B" and C" can achieve the effect similar to that by the charging device A".

Figure 29:
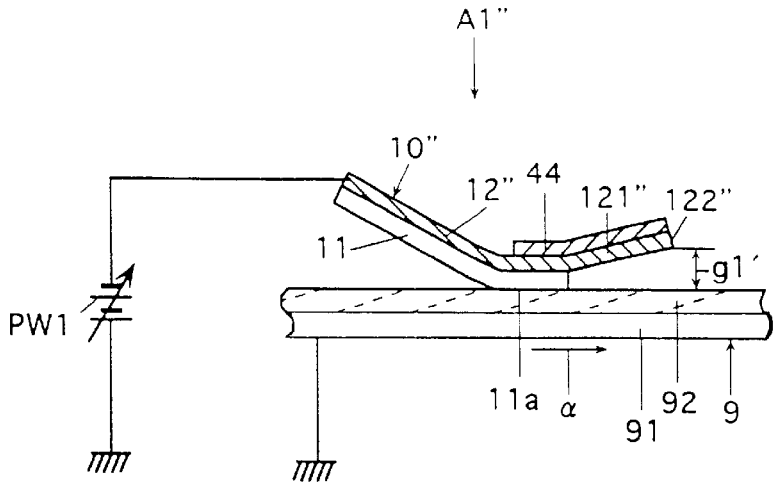
Figure 30:
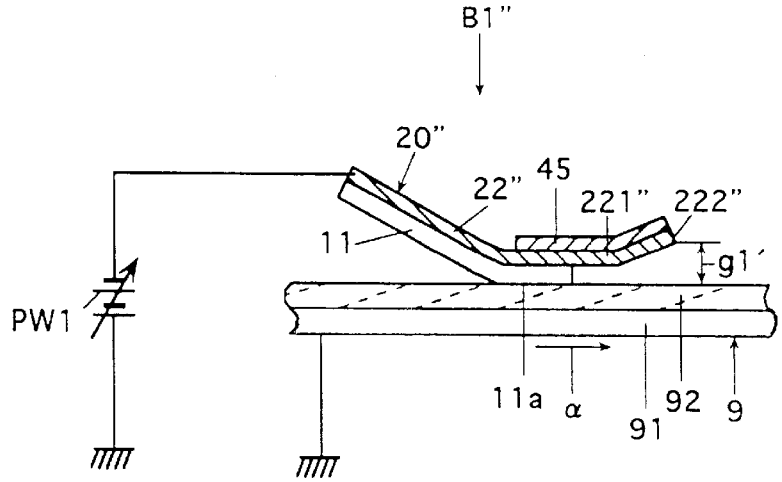
Figure 31:
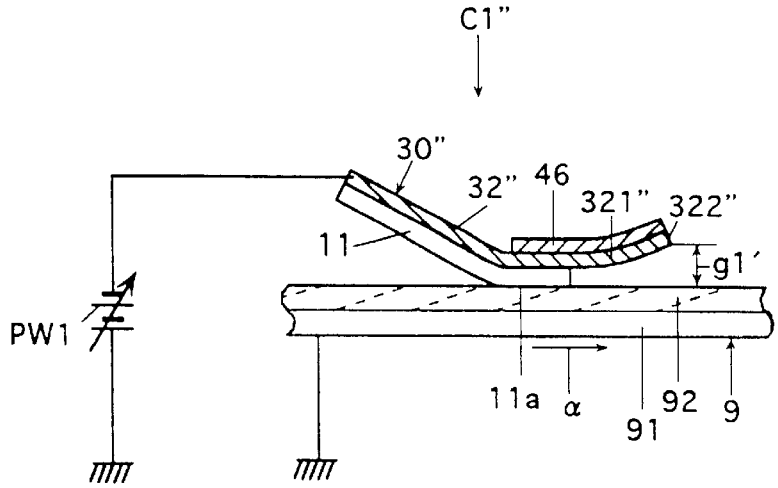

FIGS. 29 to 31 show modifications of the charging devices shown in FIGS. 26 to 28, respectively.

Charging devices A1", B1" and C1" shown in FIGS. 29 to 31 employ the sheet-like charging members, which are similar to the charging members 10", 20" and 30" of the charging devices A", B" and C" shown in FIGS. 26 to 28, but are additionally provided with reinforcing layers 44, 45 and 46 arranged on the sheet electrodes 12", 22" and 32" for preventing bending of the downstream protruding end portions 121", 221" and 321", respectively. In the charging devices shown in FIGS. 29 to 31, the same parts and portions as those in the devices shown in FIGS. 26 to 28 bear the same reference numbers. The charging devices A1", B1" and C1" shown in FIGS. 29 to 31 will be further described below.

As shown in FIGS. 29 to 31, provision of the reinforcing layers 44, 45 and 46 suppresses bending of the protruding end portions 121", 221" and 321" toward the charge target member 9 by the electrostatic attraction forces, respectively, when the sheet electrodes 12", 22" and 32" are supplied with the voltages from the power supplies PW1. Thereby, a constant distance is kept between the charge target member 9 and each of the protruding end portions 121", 221" and 321", and therefore stable charging can be performed. The protruding ends 122", 222" and 322" of these protruding end portions 121", 221" and 321" are spaced by the distance g1' not causing the discharging to the charge target member 9, and the reinforcing layers 44, 45 and 47 can suppress variation in distances between the charge target member 9 and the protruding end portions 121", 221" and 321", respectively, so that defective discharging at the protruding end portions 121", 221" and 321" is prevented, and good charging can be effected on the charge target member 9. Instead of or in addition to provision of the reinforcing layers 44, 45 and 46 at the sheet electrodes 12", 22" and 32", the thicknesses of the sheet electrodes 12", 22" and 32" themselves may be increased.

Figure 32:
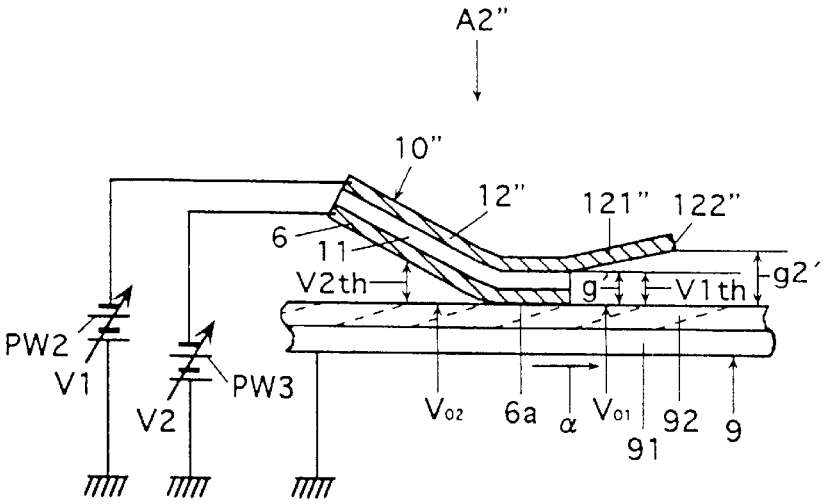
Figure 33:
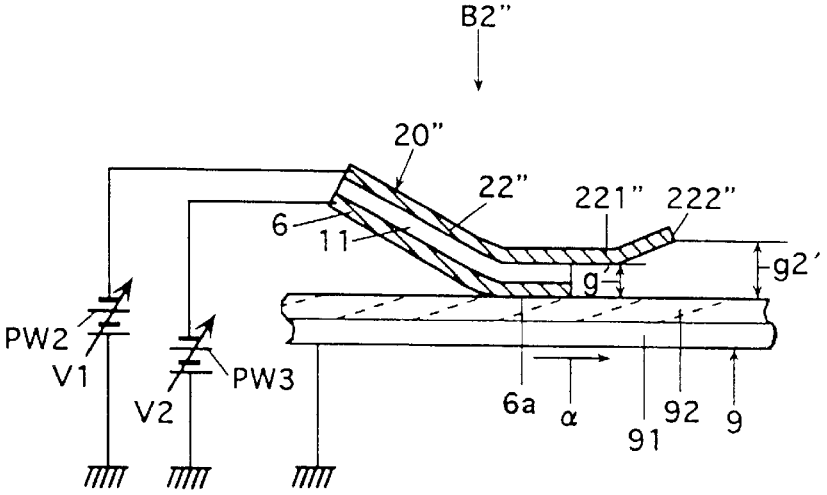
Figure 34:
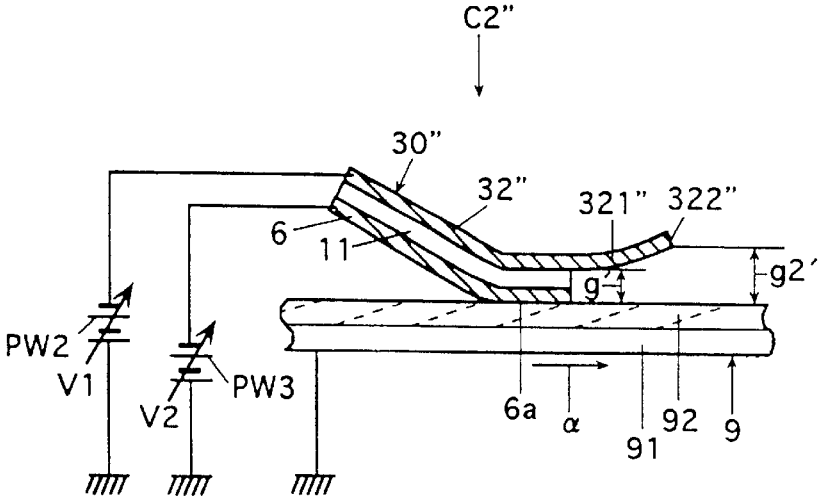

FIGS. 32 to 34 shows further modifications of the charging devices shown in FIGS. 26 to 28.

The charging device A2", B2" and C2" shown in FIGS. 32 to 34 employ the sheet-like charging members, which are similar to the sheet-like charging members 10", 20" and 30" of the charging devices A", B" and C" shown in FIGS. 26 to 28, but are additionally provided on the lower surface of the insulating sheets 11 with the sheet electrodes 6, i.e., second resistance layers made of electric resistance layers (semiconductor layers) to be in contact with the charge target members 9, respectively. In the charging devices shown in FIGS. 32 to 34, the same parts and portions as those in the devices shown in FIGS. 26 to 28 bear the same reference numbers. The charging devices A2", B2" and C2" shown in FIGS. 32 to 34 will be further described below.

As shown in FIGS. 32 to 34, the power supply PW2 is connected to each of the sheet electrodes 12", 22" and 32" on the insulating sheet 11, and supplies the DC voltage V1 to each of the sheet electrodes 12", 22" and 32" . The DC power supply PW3 is connected to the sheet electrode 6, and can apply the DC voltage V2 of the same polarity as the voltage V1 to the sheet electrode 6.

Each of the protruding end portions 121", 221" and 321" of the sheet electrodes 12", 22" and 32" maintains a constant discharging space g', which is equal to at least a total thickness of the insulating sheet 11 and the sheet electrode 6 under the same, with respect to the charge target member 9. Each of the protruding end 122", 222" and 322" of the protruding end portions 121", 221" and 321" of the sheet electrodes 12", 22" and 32" is spaced from the charge target member 9 by a distance g2' not causing discharging to the charge target member 9.

In these devices A2", B2" and C2", the sheet electrodes 6 are supplied with the voltages V2, so that the sheet-like charging members 10", 20" and 30" are electrostatically adhered onto the charge target members 9, respectively. Thereby, each of the sheet-like charging members 10", 20" and 30" can follow the charge target member in a desired manner without an influence by waving or vibration caused, e.g., by variation in surface moving speed of the charge target member, and the distance between the charge target member 9 and each of the sheet electrodes 12", 22" and 32" can be stably maintained.

The voltage V1 applied to each of the sheet electrodes 12", 22" and 32" may preferably take on the value which causes stable charging at the protruding end portion 121", 221" and 321". The conditions for enabling the stable discharging are similar to those already described in connection with the charging device D shown in FIG. 4. Similarly to the charging device D shown in FIG. 4, V1th in FIG. 32 represents the discharge start voltage on the sheet electrode 12" supplied with the voltage V1, V2th represents the discharge start voltage on the sheet electrode 6 supplied with the voltage V2, $V_{01}$ represents the surface potential of the charge target member 9 charged by the protruding end portion 121" of the sheet electrode 12", and $V_{02}$ represents the surface potential of the charge target member 9 charged by the sheet electrode 6.

In each of the charging devices A2", B2" and C2" shown in FIGS. 32 to 34, foreign matters such as toner, which passed through, e.g., a cleaning device (not shown), come to a position on the contact portion 6*a* of the sheet electrode 6 in contact with the charge target member 9. These foreign matters are charged by the DC voltage V2 applied to the sheet electrode 6 to have the same polarity as the DC voltage V1 applied to the sheet electrode 12", 22" and 32". Therefore, contamination of the protruding end portions 121", 221" and 321" of the sheet electrodes 12", 22" and 32" are prevented. Therefore, good charging can be performed.

The total thickness of the insulating sheet 11 and the sheet electrode 6 under the same, and particularly the total thicknesses of at least the contact portion 6*a* of the sheet electrode 6 to be in contact with the charge target member 9 and a portion of the insulating layer 11 near the contact portion 6*a* may be set to 11 $\mu$m or more for good charging in accordance with the Paschen's Law, and may be in a range not exceeding 300 $\mu$m and more preferably 100 $\mu$m or less in view of a relationship between the discharging distance and the ozone production rate. This total thickness of the above portions is uniformed to an extent which does not exert a significant influence on the discharging. The portion having the above thickness maintains a constant distance between the charge target member 9 and each of the protruding end portions 121", 221" and 321" of the sheet electrodes 12", 22" and 32".

The contact portion 6*a* of the sheet electrode 6 for contact with the charge target member 9 is preferably made of a material which has a high wear resistance and provides a small friction coefficient with respect to the charge target member 9.

The sheet electrodes 12", 22" and 32" as well as the sheet electrode 6 each preferably have a volume resistivity in a range from $10^3$ Ω cm to $10^7$ Ω·cm.

The discharging surface of each of the sheet electrodes 12", 22" and 32" is uniformed to an extent not exerting a significant influence on the discharging.

The sheet electrode 6 may be made of a material similar to that of the sheet electrode 12" or the like.

Figure 35:
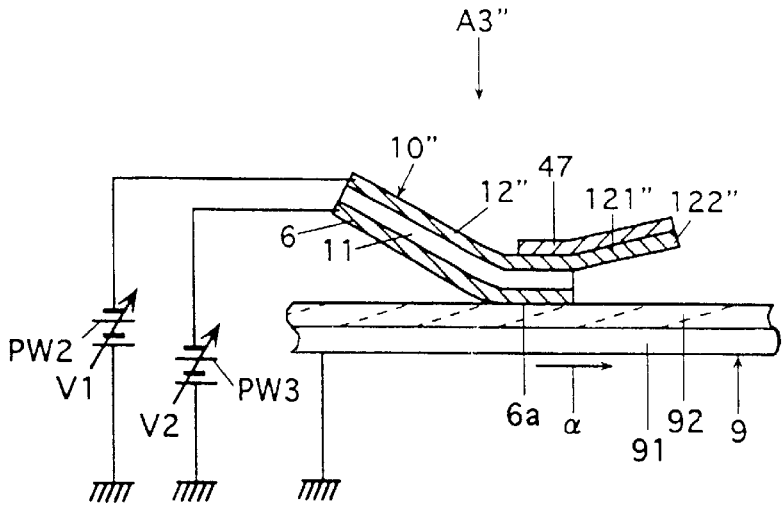
Figure 36:
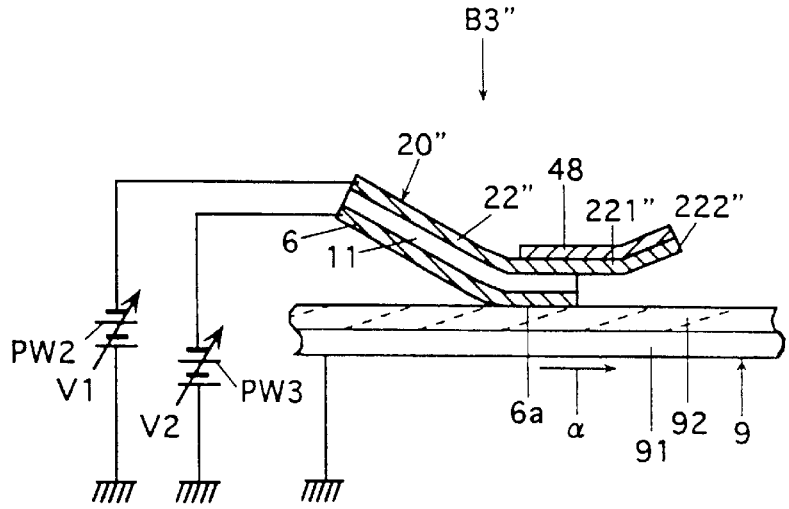
Figure 37:
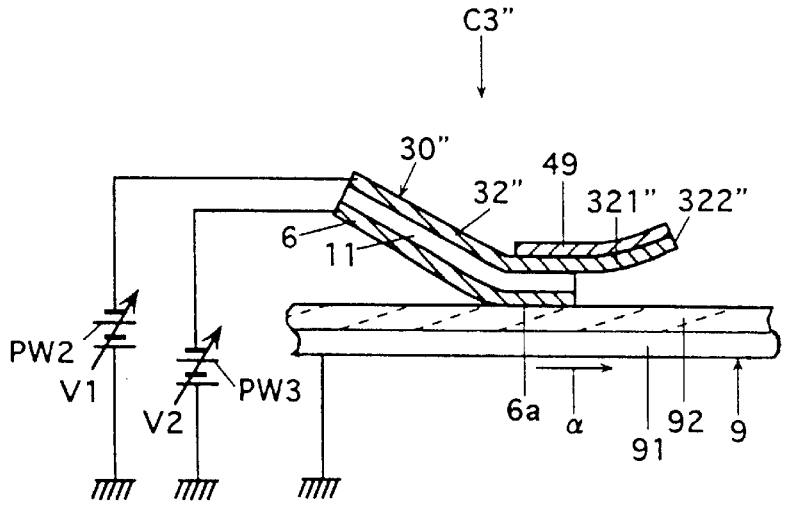

FIGS. 35 to 37 show further modifications of the charging devices shown in FIGS. 32 to 34, respectively.

Charging devices A3", B3" and C3" shown in FIGS. 35 to 37 employ sheet-like charging members which are similar to the sheet-like charging members 10", 20" and 30" of the charging devices A2", B2" and C2" shown in FIGS. 32 to 34, respectively, but are additionally provided with reinforcing layers 47, 48 and 49 arranged on the downstream protruding end portions 121", 221" and 321" of the sheet electrodes 12", 22" and 32", respectively. In FIGS. 35 to 37, the same parts and portions as those shown in FIGS. 32 to 34 bear the same reference numbers. The charging devices A3", B3" and C3" shown in FIGS. 35 to 37 will be further described below.

Provision of the reinforcing layers 47, 48 and 49 suppresses bending of the protruding end portions 121", 221" and 321" of the sheet-like electrodes toward the charge target member 9 by the electrostatic attraction forces, respectively, when the sheet electrodes 12", 22" and 32" are supplied with the voltages from the power supplies PW2. Thereby, a constant distance is kept between the charge target member 9 and each of the protruding end portions 121", 221" and 321", and therefore stable charging can be performed. Further, each of the protruding end portion 121", 221" and 321" has the protruding end 122", 222" or 322" spaced from the charge target member 9 by a distance g2' not causing the discharging to the charge target member 9, and the reinforcing layers 47, 48 and 49 can suppress variation in distance between each of the protruding end portions 121", 221" and 321" and the charge target member 9. Thereby, defective charging at the protruding end portions 121", 221" and 321" can be prevented, and therefore stable charging can be performed. In addition to or instead of provision of the reinforcing layers 47, 48 and 49 at the sheet electrodes 12", 22" and 32", the thicknesses of the sheet electrodes 12", 22" and 32" themselves may be increased.

Figure 38:
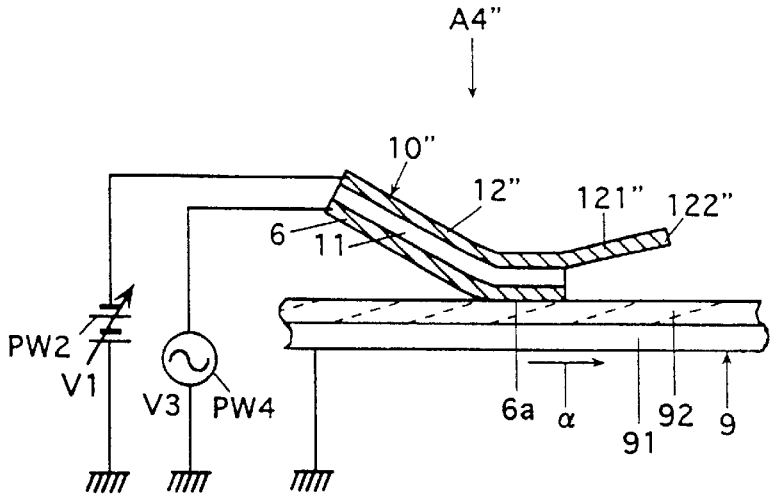
Figure 39:
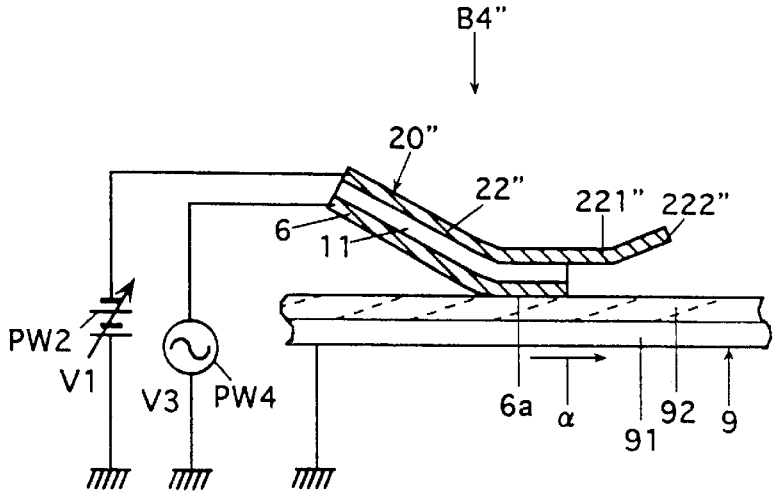
Figure 40:
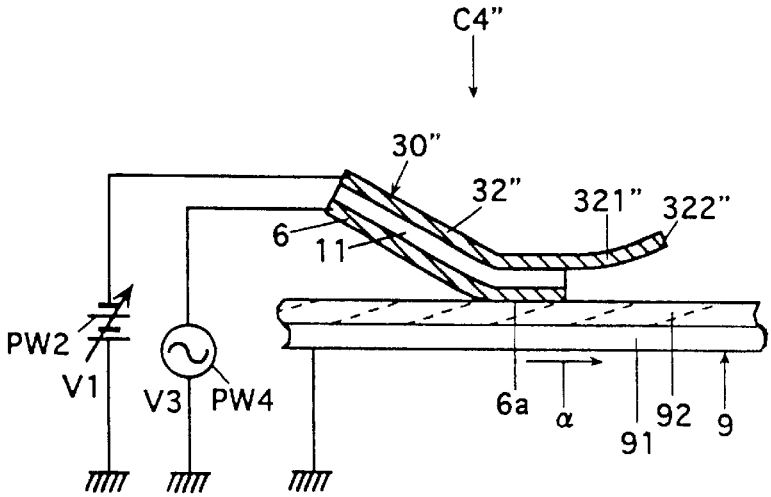

FIGS. 38 to 40 show further modifications of the charging devices shown in FIGS. 32 to 34, respectively.

Charging devices A4", B4" and C4" shown in FIGS. 38 to 40 are similar to the charging devices A2", B2" and C2" shown in FIGS. 32 to 34, respectively, but each employ, instead of the DC voltage power supply PW3, the alternating voltage power supply (AC voltage in these modifications) PW4 which is connected to the sheet electrode 6 of the sheet-like charging member 10", 20" or 30" for applying the alternating voltage V3 to the sheet electrode 6 in contact with the charge target member 9. In the charging devices shown in FIGS. 38 to 40, the same parts and portions as those shown in FIGS. 32 to 34 bear the same reference numbers.

Figure 41:
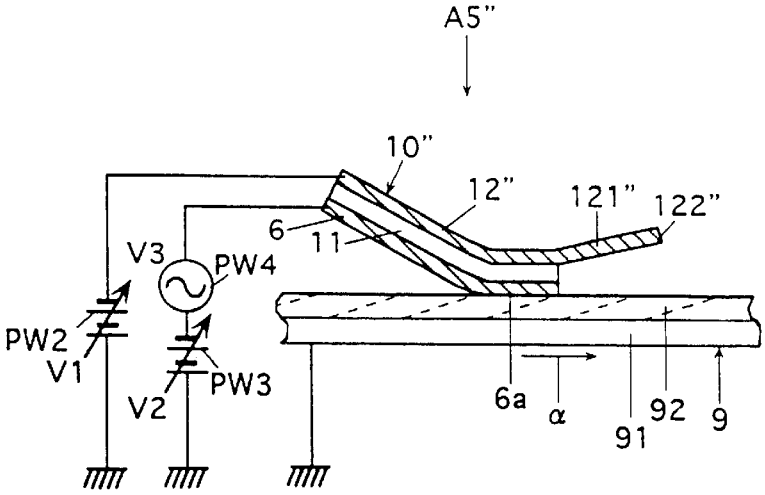
Figure 42:
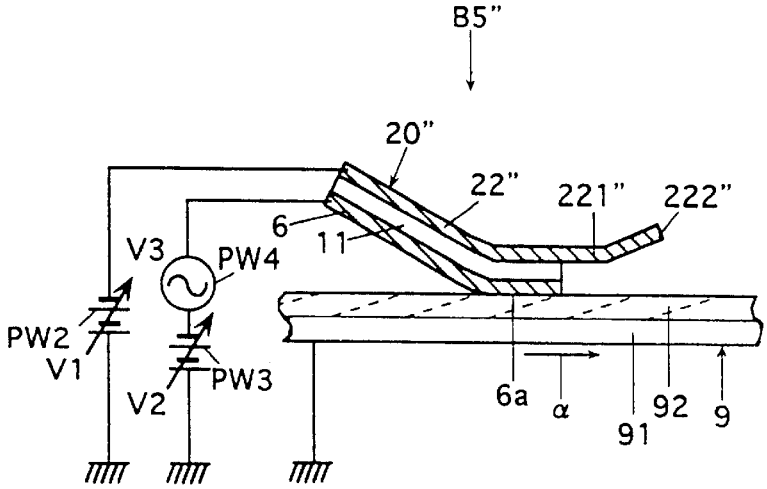
Figure 43:
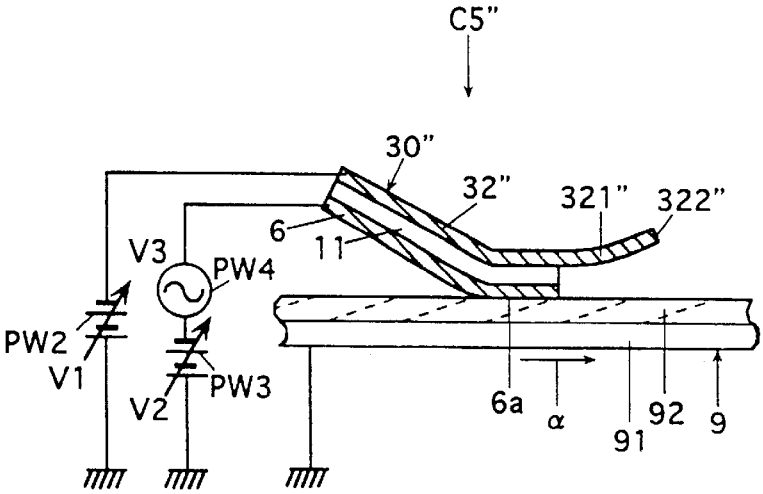

Charging devices A5", B5" and C5" shown in FIGS. 41 to 43 are similar to the charging devices A2", B2" and C2" shown in FIGS. 32 to 34, respectively, but each employ, in addition to the DC voltage power supply PW3, the alternating voltage power supply PW4 which is connected to the sheet electrode 6 of the sheet-like charging member 10", 20" or 30" for applying the DC voltage V2 and the alternating voltage V3 in a superposed manner to the sheet electrode 6 in contact with the charge target member 9. In the charging devices shown in FIGS. 41 to 43, the same parts and portions as those shown in FIGS. 32 to 34 bear the same reference numbers. The charging devices shown in FIGS. 38 to 43 will be further described below.

In the charging devices A4", B4" and C4" shown in FIGS. 38 to 40, the sheet electrodes 6 are supplied with the alternating voltages. Also, in the charging devices A5", B5" and C5" shown in FIGS. 41 to 43, the electrodes 6 are supplied with the DC voltages and the alternating voltages in a superposed manner. Owing to this, the following disadvantages can be prevented. Foreign matters, which passed through, e.g., an unillustrated cleaning device, may arrive at the sheet-like charging member 10", 20" or 30", and thereby are gathered and condensed at a position immediately upstream to the contact portion 6*a* of the charging member (more specifically, sheet electrode 6) in contact with the charge target member 9. Also, the condensed matters may enter the space between the sheet-like charging member 10", 20" or 30" and the charge target member 9, and thereby may change a distance between the protruding end portion 121", 221" or 321" of the sheet electrode 12", 22" or 32" and the charge target member 9. Further, the protruding end portion 121", 221" or 321" may be contaminated by the foreign matters. These disadvantages and defective charging caused thereby can be prevented by the application of the alternating voltage or the application of the DC voltages and the alternating voltages in a superposed manner described above.

The alternating voltage power supply may be a power supply applying an AC voltage, or a power supply applying a DC voltage while performing switching (for example, switching with pulse voltages, switching of high and low voltages, or switching of positive and negative voltages) for providing an oscillating electric field.

Although the charging devices shown in FIGS. 1 to 43 have been described, the features and advantages of the charging devices shown in FIGS. 1 to 43 may be appropriately combined to complete a charging device, which is also included in the invention.

Figure 45:
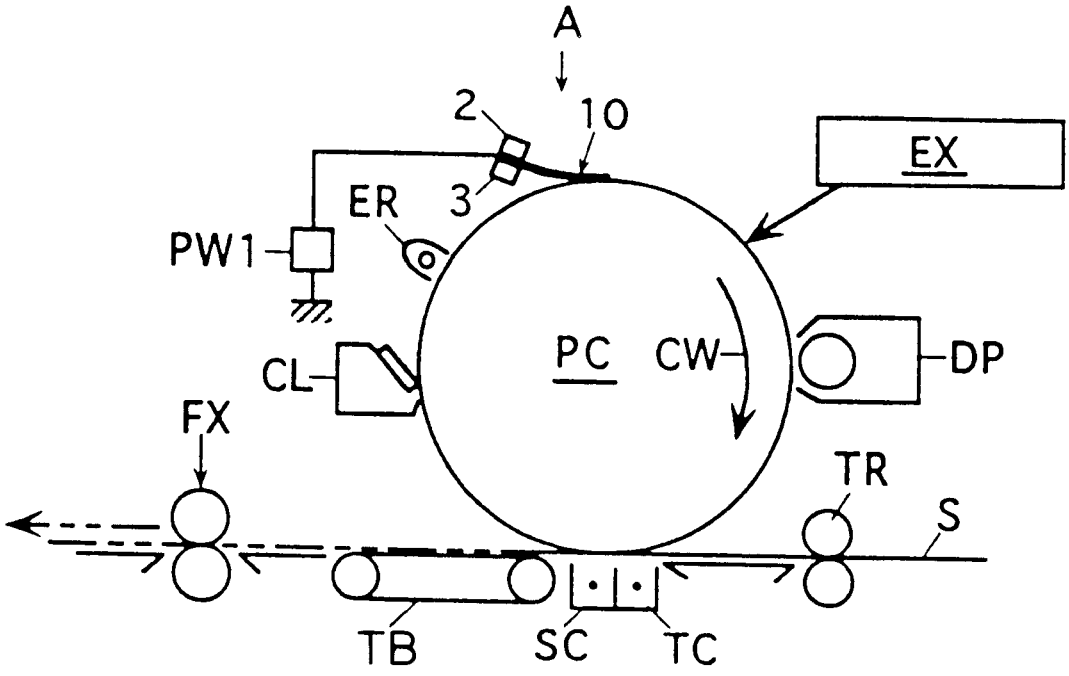
FIG. 45 shows a schematic structure of an example of an image forming apparatus including a sheet-like charging device for charging a photosensitive member.

Referring to FIG. 45, an image forming apparatus employing the charging device A shown in FIG. 1 will be described below.

The image forming apparatus shown in FIG. 45 includes an electrostatic latent image carrier (photosensitive drum in this example) PC which is a charge target member for forming an electrostatic latent image. Around the photosensitive drum PC, there are arranged the charging device A used as a charger, image exposing device EX, a developing device DP, a transfer charger TC, a separator charger SC, a cleaner CL and an eraser ER in this order.

At the right position of the transfer charger TC in the figure, there are arranged a timing roller pair TR as well as a sheet feeder unit (not shown) at the right of the roller pair TR. At the left of the separator charger SC in the figure, a transporting belt TB and a fixing device FX are arranged in this order, and a sheet discharge roller pair and a discharged sheet tray (both not shown) are arranged at the left of them.

According to this image forming apparatus, the photosensitive drum PC is driven to rotate in a direction CW indicated by an arrow in the figure by a drive device (not shown), and its surface is uniformly charged by the charging device A. The sheet electrode 12 of the charging device A is supplied with the DC voltage from the power supply PW1.

Exposure is effected by the image exposing device EX on a charged region on the photosensitive drum PC which is charged by the charging device, so that the electrostatic latent image is formed thereon. The image exposing device EX performs the exposure based on an image signal sent from an image reader or the like (not shown).

The electrostatic latent image thus formed is developed into a visible toner image by the developing device DP, and the toner image is transported to a transfer region containing the transfer charger TC. A transfer sheet (transfer paper in this example) S is supplied from the sheet feeder unit (not shown) to the timing roller pair TR, which feeds the transfer sheet S to the transfer region in synchronization with the toner image on the photosensitive drum PC.

The toner image thus transported to the transfer region is transferred onto the transfer sheet S by the transfer charger TC. After the transfer of the toner image, the transfer sheet S is separated from the separator charger SC, and is transported by the transporting belt B to the fixing device FX, which fixes the toner image. Then, the sheet discharge roller pair (not shown) discharges the sheet onto the discharged sheet tray.

Untransferred residual toner remaining on the photosensitive drum PC after the transfer of the toner image is removed by the cleaner CL, and the residual charges are removed by the eraser ER. Thereby, the apparatus is in the state of readiness for the next process.

The charging device A can stably and uniformly charge the surface of the photosensitive drum PC by the operations described above, and thereby can perform good image formation.

Instead of the charging device A, any one of the charging devices shown in FIGS. 2 to 43 may be employed. Also, the features and advantages of the charging devices shown in FIGS. 1 to 43 may be appropriately combined to complete a charging device, and this device may be employed instead of the charging device A. In this case, the advantages of those devices already described can be achieved, resulting in further improved image formation.

Generation of ozone from such charging devices are suppressed. In the apparatus employing any one of the charging devices shown in FIGS. 1 to 43, the sheet-like charging member can be arranged in a flat form on the photosensitive drum PC, so that the image forming apparatus can have a compact structure.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A charging device for charging a charge target member, said charging device comprising:

a sheet-like charging member to be brought into contact with the charge target member, and having an insulating layer and a first resistance layer; and a first voltage application device for applying a DC voltage to said first resistance layer, wherein said insulating layer of said charging member is arranged at a side of said first resistance layer neighboring to said charge target member, and said first resistance layer has a downstream end portion, in a surface moving direction of said charge target member, protruding from said insulating layer in the surface moving direction of the charge target member, and wherein said insulating layer is for keeping a gap between said downstream protruding end portion of said first resistance layer and said charge target member, and said downstream protruding end portion of said first resistance layer contributes to the charging of said charge target member.

2. The charging device according to claim 1, wherein said sheet-like charging member is provided with a second resistance layer arranged at a side of said insulating layer neighboring to said charge target member, and a second voltage application device is provided for applying a voltage to said second resistance layer.

3. The charging device according to claim 2, wherein said second voltage application device for applying the voltage to said second resistance layer is a DC voltage application device.

4. The charging device according to claim 1, wherein the protruding end of said downstream protruding end portion of said first resistance layer is co ated with an insulating layer.

5. The charging device according to claim 1, wherein the protruding end of said downstream protruding end portion of said first resistance layer is roundly folded back away from said charge target member.

6. The charging device according to claim 1, wherein the protruding end of said downstream protruding end portion of said first resistance layer is bent away from said charge target member, and the convex outer surface of the bent portion is round and has an arc-shaped section.

7. The charging device according to claim 1, wherein the protruding end itself of said downstream protruding end portion of said first resistance layer is rounded to have an arc-shaped section.

8. The charging device according to claim 1, wherein said downstream protruding end portion of said first resistance layer extends toward its protruding end in a form diverging with respect to said charge target member to space said protruding end from said charge target member by a distance not causing discharging to said charge target member.

9. The charging device according to claim 1, wherein said first resistance layer has a volume resistivity in a range from $10^3$ Ω·cm to $10^7$ Ω·cm.

10. The charging device according to claim 1, wherein a distance from 11 μm to 100 μm is set between said charge target member and said first resistance layer at the region of contact between said sheet-like charging member and said charge target member.

11. A device comprising:

a sheet-like member to be brought into contact with a target member, and having an insulating layer and a first resistance layer; and a first voltage application device for applying a DC voltage to said first resistance layer, wherein said insulating layer of said sheet-like member is arranged at a side of said first resistance layer neighboring to said target member, and said first resistance layer has a downstream end portion, in a surface moving direction of said target member, protruding from said insulating layer in the surface moving direction of the target member, wherein said sheet-like member is provided with a second resistance layer arranged at a side of said insulating layer neighboring to said target member, and a second voltage application device is provided for applying a voltage to said second resistance layer, wherein said second voltage application device for applying the voltage to said second resistance layer is a DC voltage application device, and wherein said first voltage application device for applying the DC voltage to said first resistance layer and said second voltage application device for applying the DC voltage to said second resistance layer are adapted such that the DC voltage applied to said second resistance layer is of the same polarity as the DC voltage applied to said first resistance layer, and is lower than the DC voltage applied to said first resistance layer.

12. A device comprising:

a sheet-like member to be brought into contact with a target member, and having an insulating layer and a first resistance layer; and a first voltage application device for applying a DC voltage to said first resistance layer, wherein said insulating layer of said sheet-like member is arranged at a side of said first resistance layer neighboring to said target member, and said first resistance layer has a downstream end portion, in a surface moving direction of said target member, protruding from said insulating layer in the surface moving direction of the target member, wherein said sheet-like member is provided with a second resistance layer arranged at a side of said insulating layer neighboring to said target member, and a second voltage application device is provided for applying a voltage to said second resistance layer, wherein said second voltage application device for applying the voltage to said second resistance layer is an oscillating voltage application device.

13. A device comprising:

a sheet-like member to be brought into contact with a target member, and having an insulating layer and a first resistance layer; and a first voltage application device for applying a DC voltage to said first resistance layer, wherein said insulating layer of said sheet-like member is arranged at a side of said first resistance layer neighboring to said target member, and said first resistance layer has a downstream end portion, in a surface moving direction of said target member, protruding from said insulating layer in the surface moving direction of the target member, wherein said sheet-like member is provided with a second resistance layer arranged at a side of said insulating layer neighboring to said target member, and a second voltage application device is provided for applying a voltage to said second resistance layer, wherein said second voltage application device for applying the voltage to said second resistance layer is a device applying a DC voltage and an oscillating voltage in a superposed manner.

14. A device comprising:

a sheet-like member to be brought into contact with a target member, and having an insulating layer and a first resistance layer; and a first voltage application device for applying a DC voltage to said first resistance layer, wherein said insulating layer of said sheet-like member is arranged at a side of said first resistance layer neighboring to said target member, and said first resistance layer has a downstream end portion, in a surface moving direction of said target member, protruding from said insulating layer in the surface moving direction of the target member, wherein said downstream protruding end portion of said first resistance layer extends toward its protruding end in a form diverging with respect to said target member to space said protruding end from said target member by a distance not causing discharging to said target member, and wherein said downstream protruding end portion of said first resistance layer extends toward its protruding end such that a portion of said downstream protruding end portion extending from its intermediate position to the protruding end diverges with respect to the target member.

15. A device comprising:

a sheet-like member to be brought into contact with a target member, and having an insulating layer and a first resistance layer; and a first voltage application device for applying a DC voltage to said first resistance layer, wherein said insulating layer of said sheet-like member is arranged at a side of said first resistance layer neighboring to said target member, and said first resistance layer has a downstream end portion, in a surface moving direction of said target member, protruding from said insulating layer in the surface moving direction of the target member, wherein said downstream protruding end portion of said first resistance layer extends toward its protruding end in a form diverging with respect to said target member to space said protruding end from said target member by a distance not causing discharging to said charge target member, and wherein said downstream protruding end portion of said first resistance layer extends toward its protruding end to form an arc-shaped section diverging with respect to the target member.

16. A device comprising:

a sheet-like member to be brought into contact with a target member, and having an insulating layer and a first resistance layer; and a first voltage application device for applying a DC voltage to said first resistance layer, wherein said insulating layer of said sheet-like member is arranged at a side of said first resistance layer neighboring to said target member, and said first resistance layer has a downstream end portion, in a surface moving direction of said target member, protruding from said insulating layer in the surface moving direction of the target member, wherein said sheet-like charging member has a reinforcing layer provided for at least said downstream protruding end portion of said first resistance layer.

17. The charging device according to claim 16, wherein said reinforcing layer is arranged at the side of said first resistance layer remote from said charge target member.

18. A device comprising:

a sheet-like member to be brought into contact with a target member, and having an insulating layer and a first resistance layer; and a first voltage application device applying a DC voltage to said first resistance layer, wherein said insulating layer of said sheet-like member is arranged at a side of said first resistance layer neighboring to said target member, and said first resistance layer has a downstream end portion, in a surface moving direction of said target member, protruding from said insulating layer in the surface moving direction of said target member, wherein said sheet-like member is provided with a second resistance layer arranged at a side of said insulating layer neighboring to said target member, and a second voltage application device is provided for applying a voltage to said resistance layer, wherein each of said first and second resistance layers has a volume resistivity in a range from $10^3$ Ω·cm to $10^7$ Ω·cm.

19. An image forming apparatus for forming an electrostatic latent image on a charge target member and developing the electrostatic latent image to form an image, said image forming apparatus including a charging device for charging said charge target member, said charging device comprising:

a sheet-like charging member to be brought into contact with said charge target member, and having an insulating layer and a first resistance layer; and a first voltage application device for applying a DC voltage to said first resistance layer, wherein said insulating layer of said charging member is arranged at a side of said first resistance layer neighboring to said charge target member, and said first resistance layer has a downstream end portion, in a surface moving direction of said charge target member, protruding from said insulating layer in the surface moving direction of the charge target member, and wherein said insulating layer is for keeping a gap between said downstream protruding end portion of said first resistance layer and said charge target member, and said downstream protruding end portion of said first resistance layer contributes a charging of said charge target member.

20. The image forming apparatus according to claim 19, wherein said sheet-like charging member is held at its end remote from said downstream protruding end portion by a body of the image forming apparatus.

21. The image forming apparatus according to claim 19, wherein said sheet-like charging member is provided with a second resistance layer arranged at a side of said insulating layer neighboring to said charge target member, and a second voltage application device is provided for applying a voltage to said second resistance layer.

22. An image forming apparatus for forming an electrostatic latent image and developing the electrostatic latent image to form an image, said image forming apparatus comprising:

a sheet-like member to be brought into contact with a target member, and having an insulating layer and a first resistance layer; and a first voltage application device for applying a DC voltage to said first resistance layer, wherein said insulating layer of said charging member is arranged at a side of said first resistance layer neighboring to said target member, and said first resistance layer has a downstream end portion, in a surface moving direction of said target member, protruding from said insulating layer in the surface moving direction of the target member, and wherein said sheet-like charging member has a reinforcing layer provided for at least said downstream protruding end portion of said first resistance layer.

* * * * *